US010991532B2

(12) United States Patent
Ito et al.

(10) Patent No.: US 10,991,532 B2
(45) Date of Patent: Apr. 27, 2021

(54) CONTACT DEVICE AND ELECTROMAGNETIC RELAY MOUNTED WITH SAME

(71) Applicant: Panasonic Intellectual Property Management Co., Ltd., Osaka (JP)

(72) Inventors: Masahiro Ito, Mie (JP); Tsukasa Nishimura, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 231 days.

(21) Appl. No.: 16/103,323

(22) Filed: Aug. 14, 2018

(65) Prior Publication Data

US 2019/0035586 A1 Jan. 31, 2019

Related U.S. Application Data

(62) Division of application No. 14/392,130, filed as application No. PCT/JP2014/003431 on Jun. 27, 2014, now Pat. No. 10,090,127.

(30) Foreign Application Priority Data

Jun. 28, 2013 (JP) ..... 2013-136993

(51) Int. Cl.
*H01F 1/00* (2006.01)
*H01H 50/56* (2006.01)
(Continued)

(52) U.S. Cl.
CPC ..... *H01H 50/56* (2013.01); *H01H 50/36* (2013.01); *H01H 50/60* (2013.01); *H01H 51/065* (2013.01); *H01H 2235/01* (2013.01)

(58) Field of Classification Search
CPC ..... H01H 50/20; H01H 50/25; H01H 50/54; H01H 50/56; H01H 50/64; H01H 50/18;
(Continued)

(56) References Cited

U.S. PATENT DOCUMENTS 4,307,361 A 12/1981 Grunert et al.
4,509,026 A 4/1985 Matsushita
(Continued)

FOREIGN PATENT DOCUMENTS

CN 102834891 A 12/2012
JP 2006-261056 A 9/2006
(Continued)

OTHER PUBLICATIONS

International Search Report and Written Opinion issued in corresponding International Patent Application No. PCT/JP2014/003431, dated Jul. 29, 2014 (with English translation of Search Report).
(Continued)

*Primary Examiner* — Shawki S Ismail
*Assistant Examiner* — Lisa N Homza
(74) *Attorney, Agent, or Firm* — McDermott Will and Emery LLP

(57) ABSTRACT

A contact device includes: a contact block which includes a fixed contact, and a movable contactor including a movable contact formed to come into and out of contact with the fixed contact; a driving block including a driving shaft which moves the movable contactor, the driving block configured to drive the driving shaft so that the movable contact can come into and out of contact with the fixed contact; and a yoke disposed on one side of the movable contactor in a driving direction and fixed to the movable contactor. One of the yoke and the movable contactor includes a projection projected to the driving direction, and the other of the yoke
(Continued)

and the movable contactor includes an insertion hole in which to insert the projection.

15 Claims, 30 Drawing Sheets

(51) Int. Cl.
*H01H 50/36* (2006.01)
*H01H 50/60* (2006.01)
*H01H 51/06* (2006.01)

(58) Field of Classification Search
CPC ..... H01H 50/44; H01H 50/645; H01H 50/04; H01H 50/10; H01H 50/30; H01H 50/305; H01H 50/546; H01H 51/065; H01H 51/2209; H01H 51/2201; H01F 2/0278
USPC ..... 335/187
See application file for complete search history.

(56) References Cited

U.S. PATENT DOCUMENTS 5,892,184 A 4/1999 D'Hoogh
5,892,194 A 4/1999 Uotome et al.
5,892,422 A 4/1999 Montaigu et al.
5,959,519 A * 9/1999 Gobel ..... H01F 7/1615 335/132
5,986,529 A * 11/1999 Miyata ..... H01H 50/60 335/129
6,911,884 B2 6/2005 Uotome et al.
6,975,194 B2 12/2005 Nishida et al.
7,023,306 B2 4/2006 Nishida et al.
7,286,031 B2 10/2007 Nishida et al.
7,504,916 B2 * 3/2009 Masaki ..... H01H 50/30 335/104
7,551,049 B2 * 6/2009 Hirabayashi ..... H01H 51/065 335/106
7,852,178 B2 12/2010 Bush et al.
7,872,551 B2 * 1/2011 Nakamura ..... H01H 50/54 335/4
7,876,183 B2 1/2011 Uruma et al.
7,911,304 B2 3/2011 Yano et al.
8,179,217 B2 5/2012 Kawaguchi et al.
8,269,585 B2 * 9/2012 Choi ..... H01H 1/2008 335/126
8,274,347 B2 9/2012 Eum
8,330,565 B2 12/2012 Eum
8,354,905 B2 1/2013 Eum
8,549,734 B2 10/2013 Yeon
8,552,824 B1 10/2013 Pal
8,653,913 B2 2/2014 Vellaiyanaicken et al.
8,653,915 B2 2/2014 Schmidt et al.
8,653,917 B2 2/2014 Takaya et al.
8,994,482 B2 3/2015 Yokoyama et al.
9,196,442 B2 11/2015 Ito et al.
2004/0080389 A1 4/2004 Nishida et al.
2005/0146405 A1 7/2005 Nishida et al.
2006/0050466 A1 3/2006 Enomoto et al.
2007/0241847 A1 10/2007 Yamamoto et al.
2009/0322454 A1 12/2009 Tanaka et al.
2009/0322455 A1 * 12/2009 Yoshihara ..... H01H 50/36 335/189
2010/0289604 A1 * 11/2010 Kojima ..... H02H 9/001 335/133
2011/0032059 A1 2/2011 Ito et al.
2011/0221548 A1 9/2011 Yoshihara et al.
2012/0092095 A1 4/2012 Lim
2012/0092096 A1 4/2012 Choi
2012/0139670 A1 6/2012 Yamagata et al.
2012/0326815 A1 12/2012 Suzuki et al.
2013/0012037 A1 1/2013 Enomoto et al.
2013/0021122 A1 1/2013 Uchida
2013/0057369 A1 3/2013 Yano et al.
2013/0088312 A1 4/2013 Isonaga
2013/0214884 A1 8/2013 Ito et al.
2013/0234811 A1 9/2013 Nishimura
2013/0342293 A1 12/2013 Yamamoto et al.
2014/0092517 A1 4/2014 Sora
2014/0232489 A1 8/2014 Kubono et al.
2015/0022291 A1 1/2015 Kashimura et al.
2015/0022292 A1 1/2015 Tachikawa et al.
2015/0022296 A1 1/2015 Takaya et al.
2015/0054605 A1 2/2015 Kubono et al.
2015/0187527 A1 7/2015 Kubono et al.
2015/0194284 A1 7/2015 Uruma et al.
2015/0213980 A1 7/2015 Lee
2015/0213981 A1 7/2015 Choi
2015/0213982 A1 7/2015 Lim
2015/0380194 A1 12/2015 Lee
2016/0155592 A1 6/2016 Ito et al.
2016/0181038 A1 6/2016 Shimizu et al.
2016/0225565 A1 8/2016 Sugisawa et al.
2016/0233039 A1 8/2016 Kanematsu et al.
2016/0260566 A1 9/2016 Shima et al.

FOREIGN PATENT DOCUMENTS

JP 2010-010055 A 1/2010
JP 2011-204479 A 10/2011
JP 2012-022982 A 2/2012
JP 2012-199133 A 10/2012

OTHER PUBLICATIONS

Notice of Allowance issued in corresponding U.S. Appl. No. 14/392,130 dated May 18, 2018.
Final Office Action issued in corresponding U.S. Appl. No. 14/392,130 dated Aug. 11, 2017.
Office Action issued in corresponding U.S. Appl. No. 14/392,130 dated Dec. 29, 2017.
Office Action issued in corresponding U.S. Appl. No. 14/392,130 dated Mar. 13, 2017.

* cited by examiner 100
100
9
30
3(1)
31
51
52
33
49
18
14a
21(6)
21a
11
15f
15
14b
13
11a
14
2(1)
19a
19c
17
12
16
19(6)
41c
41
29
29a
25
51a
52a
41b
41d
15e
7
10b
10
72
49a
40
49
15b
21b
15d
15a
23
15c
13
14c
17a
20a
71
20
35b
32
9
3(1)
41
41d
52(50)
33
15e
49
21(6)
14a
11
21a
15
14b
13
11a
14
2(1)
20a
19b
19a
19c
17
15d
12
16
11
19(6)
10
29
51(50)
51a
25
25a
35a
35
10a
10
S
41a
29b
29a
49a
40
49
15b
18
21b
15f
15a
15c
14c
17a
20a

CONTACT DEVICE AND ELECTROMAGNETIC RELAY MOUNTED WITH SAME

CROSS REFERENCE

This application is a Divisional of U.S. application Ser. No. 14/392,130 filed on Dec. 23, 2015, now U.S. Pat. No. 10,090,127, which is the U.S. National Phase under 35 U.S.C. § 371 of International Application No. PCT/JP/2014/003431 filed on Jun. 27, 2014, which claims the benefit of Japanese Application No. 2013-136993 filed on Jun. 28, 2013, the entire contents of each are hereby incorporated by reference.

TECHNICAL FIELD

The present invention relates to a contact device and an electromagnetic relay mounted with the same.

BACKGROUND ART

There has been known a contact device which includes: a contact block including fixed terminals provided with fixed contacts, and a movable contactor provided with movable contacts configured to come into and out of contact with the fixed contacts; and a driving block including a driving shaft configured to drive the movable contactor (for example, see Patent Literature 1).

According to Patent Literature 1, the movable contactor is attached to an end portion of the driving shaft formed to reciprocate in its axial direction. In addition, the movable contactor is held between and by an upper yoke and a lower yoke, and is biased by a contact pressure spring toward the fixed contacts. While the movable contacts and the fixed contacts are in contact with each other to allow the flow of electric current, the upper yoke and the lower yoke form a magnetic circuit to produce magnetic force of causing the upper yoke and the lower yoke to attract each other, and thus restrict the movement of the movable contactor away from the fixed contacts.

CITATION LIST

Patent Literature

Patent Literature 1: Japanese Patent Laid-open Publication No. 2012-022982

SUMMARY OF INVENTION

Technical Problem

Meanwhile, it is desirable that the positional displacement of the yoke relative to the movable contactor is inhibited.

With the above taken into consideration, an object of the present invention is to obtain a contact device and an electromagnetic relay mounted with the contact device which both achieve an inhibition the positional displacement of the yoke relative to the movable contactor.

Solution to Problem

A gist of a contact device of the present invention is as follows. The contact device includes: a contact block which includes a fixed contact, and a movable contactor including a movable contact formed to come into and out of contact with the fixed contact; a driving block including a driving shaft which moves the movable contactor, the driving block configured to drive the driving shaft so that the movable contact can come into and out of contact with the fixed contact; and a yoke disposed on one side of the movable contactor in a driving direction and fixed to the movable contactor. One of the yoke and the movable contactor includes a projection projected to the driving direction, and the other of the yoke and the movable contactor includes an insertion hole in which to insert the projection.

Another gist of the contact device of the present invention is that the projection is fixed in the insertion hole.

Another gist of the contact device of the present invention is that the projection is press-fitted to the insertion hole.

Another gist of the contact device of the present invention is that the projection formed in the one is fixed to the other by swaging.

Another gist of the contact device of the present invention is that the insertion hole includes a step, and the projection is fixed to the step by swaging.

Another gist of the contact device of the present invention is that the projection is welded to the insertion hole.

Another gist of the contact device of the present invention is that the insertion hole includes a tapered portion with which the projection is brought into contact.

Another gist of the contact device of the present invention is that the projection is formed by dowel formation processing.

Another gist of the contact device of the present invention is that: the one is the yoke and the other is the movable contactor, and the yoke includes the projection and a bottom wall portion provided with the projection, wherein the yoke is fixed to the movable contactor by interposing a part of the movable contactor between the projection and the bottom wall portion in the driving direction.

Another gist of the contact device of the present invention is that: the one is the yoke and the other is the movable contactor, and the yoke includes a first member as the projection and a second member provided with the projection, wherein the yoke is fixed to the movable contactor by interposing a part of the movable contactor between the first member and the second member in the driving direction.

Another gist of the contact device of the present invention is that the projection is formed in a state where the one of the yoke and the movable contactor is bended such that the projection projects to the driving direction.

Another gist of the contact device of the present invention is that the yoke includes a bottom wall portion, and side wall portions formed to two ends of the bottom wall portion and projecting in the driving direction.

Another gist of the contact device of the present invention is that the contact device further comprises a biasing portion configured to bias the movable contactor toward the other side in the driving direction.

The other gist of an electromagnetic relay of the present invention is that the foregoing contact device is mounted on the electromagnetic relay and the electromagnetic relay opens and closes the fixed contact and the movable contact depending on whether or not a coil is electrified.

Advantageous Effects of Invention

The present invention makes it possible to obtain the contact device and the electromagnetic relay mounted with the contact device which both achieve an inhibition the positional displacement of the yoke relative to the movable contactor.

BRIEF DESCRIPTION OF DRAWINGS

FIG. 4(*a*) is a cross-sectional view. FIG. 4(*b*) is a side cross-sectional view taken in a direction orthogonal to a direction in which the view of FIG. 4(*a*) is taken.

FIG. 8(*a*) is a perspective view. FIG. 8(*b*) is a cross-sectional view.

FIG. 9(*a*) is a perspective view. FIG. 9(*b*) is a cross-sectional view.

FIG. 10(*a*) is a perspective view. FIG. 10(*b*) is a cross-sectional view.

FIG. 11(*a*) is a perspective view. FIG. 11(*b*) is a cross-sectional view.

FIG. 13(*a*) is a perspective view. FIG. 13(*b*) is a cross-sectional view.

FIG. 14(*a*) is a perspective view. FIG. 14(*b*) is a cross-sectional view.

FIG. 15(*a*) is a perspective view. FIG. 15(*b*) is a cross-sectional view.

FIG. 16(*a*) is a perspective view. FIG. 16(*b*) is a cross-sectional view.

FIG. 17(*a*) is a perspective view. FIG. 17(*b*) is a cross-sectional view.

FIG. 18(*a*) is a perspective view. FIG. 18(*b*) is a cross-sectional view.

FIG. 27 is a cross-sectional view schematically showing the electromagnetic relay shown in FIG. 26 with the power supply being on.

FIG. 39(*a*) is a perspective view. FIG. 39(*b*) is an exploded perspective view.

DESCRIPTION OF EMBODIMENTS

Figure 1:
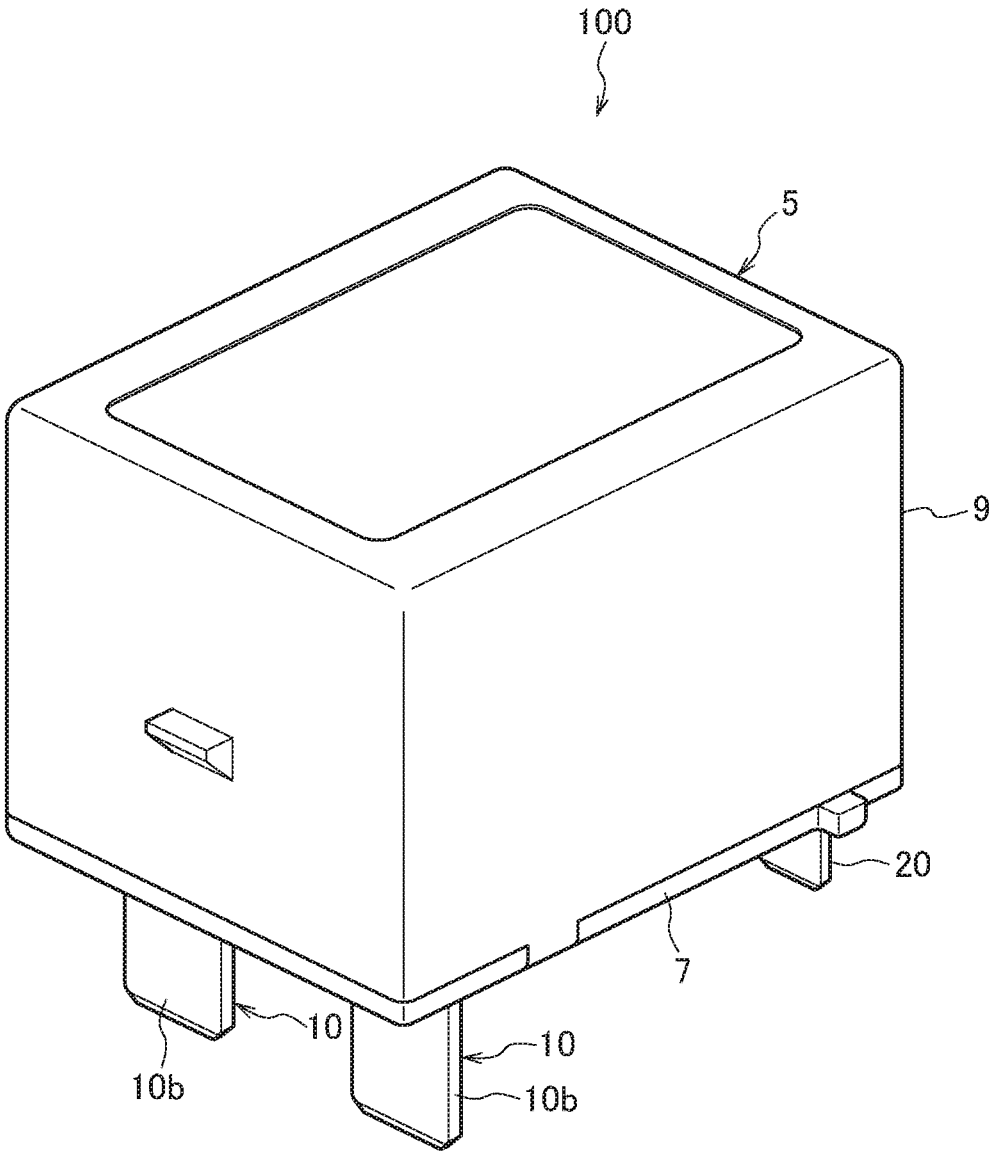
FIG. 1 is a perspective view showing an electromagnetic relay of an embodiment of the present invention.

Referring to the drawings, an embodiment of the present invention will be hereinbelow described in detail. Incidentally, the following descriptions will be provided with the top, bottom, left and right in FIG. 4(*b*) coinciding with the top, bottom, left and right of an electromagnetic relay, and with the left and right in FIG. 4(*a*) coinciding with the front and back of the electromagnetic relay.

Figure 2:
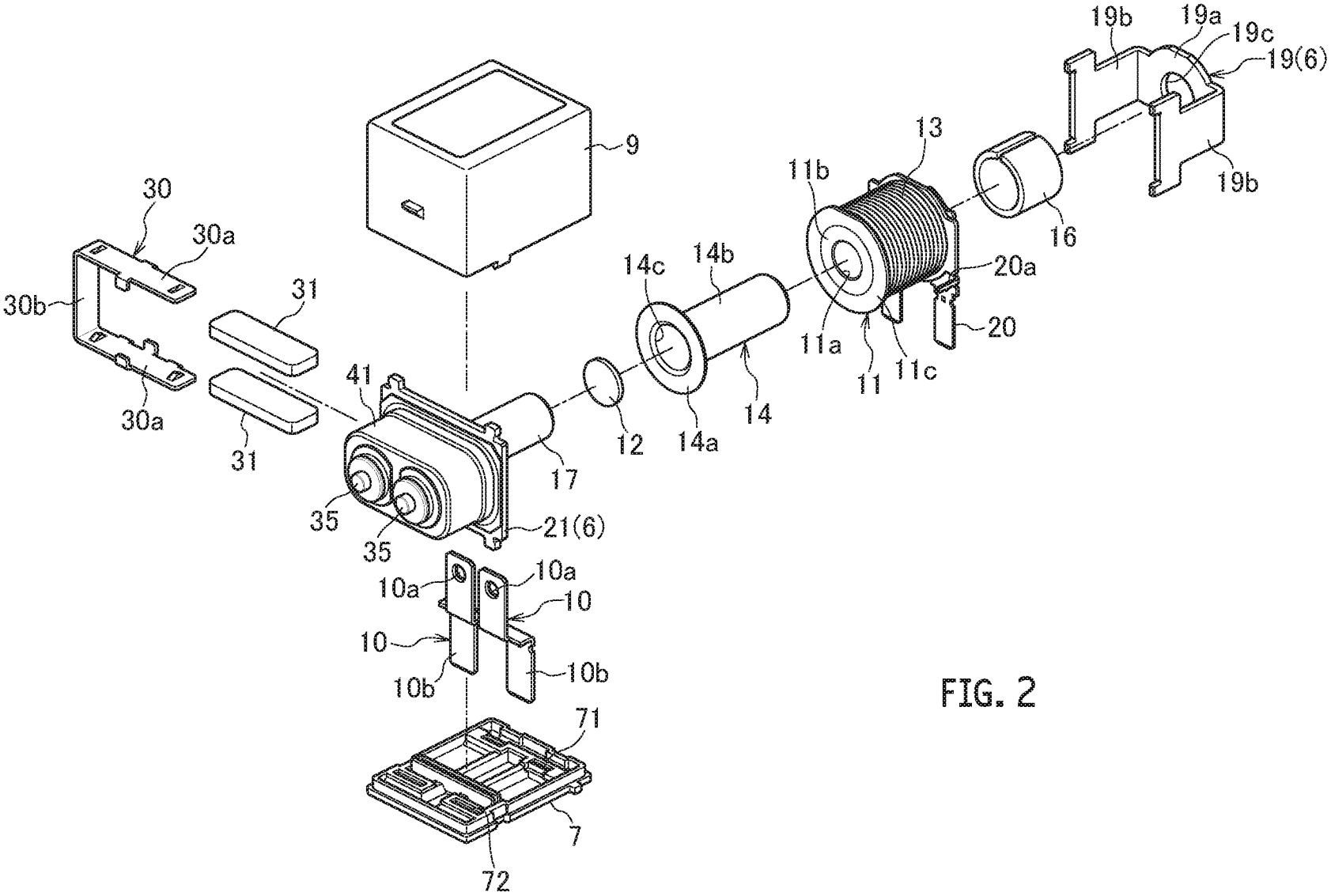
FIG. 2 is an exploded perspective view showing the electromagnetic relay of the embodiment of the present invention.
Figure 3:
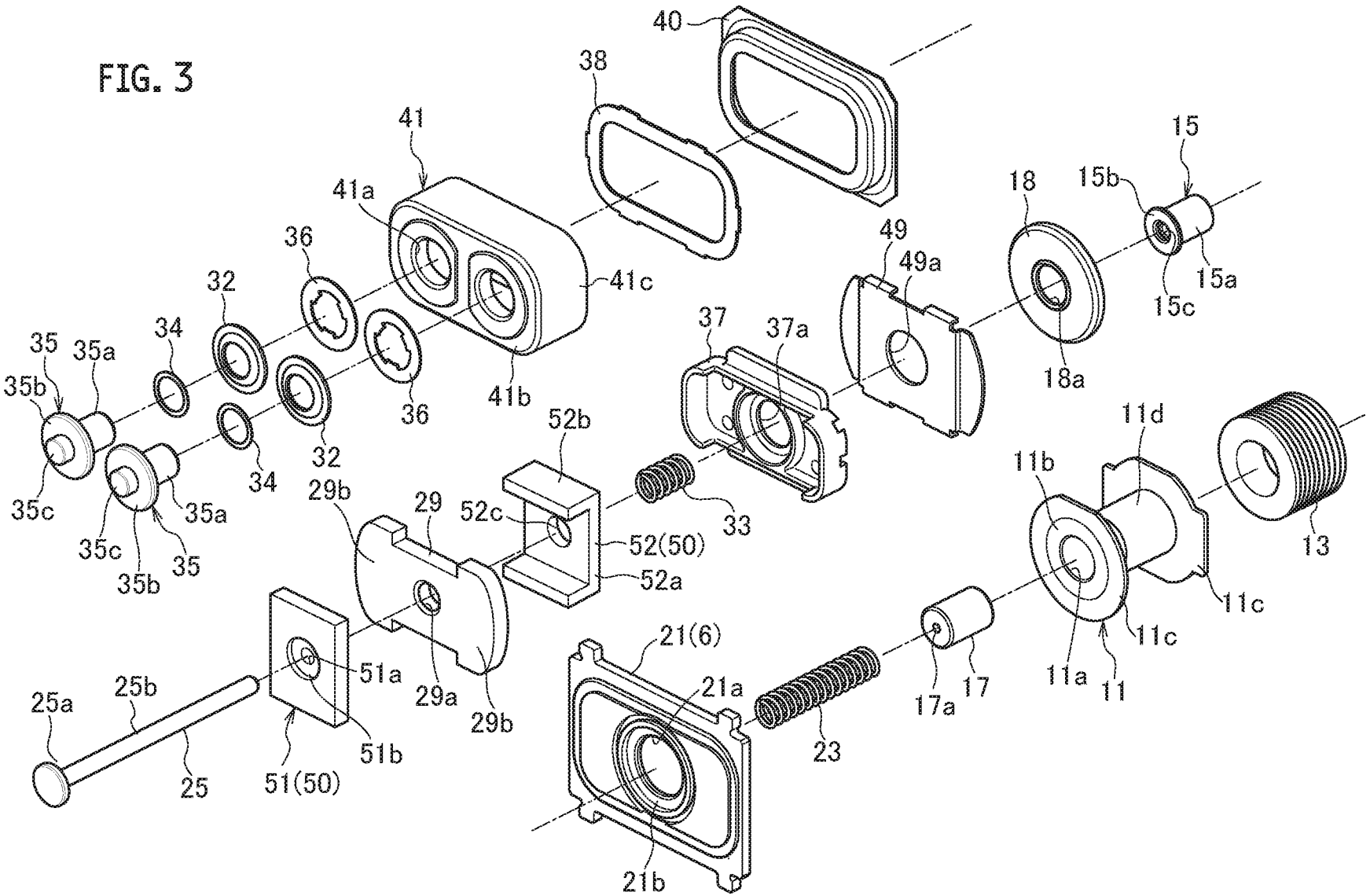
FIG. 3 is an exploded perspective view showing a part of a contact device of the embodiment of the present invention in a disassembled manner.

An electromagnetic relay 100 of the embodiment is a so-called normally-open electromagnetic relay whose contacts are off while in the initial state. As shown in FIGS. 1 to 3, the electromagnetic relay 100 includes a contact device 1 constructed by integrally combining a driving block 2 to be located in a lower portion of the contact device 1 and a contact block 3 to be located in an upper portion of the contact device 1. In addition, the contact device 1 is housed inside a case 5 shaped like a hollow box. Incidentally, a so-called normally-closed electromagnetic relay whose contacts are on while in the initial state may be used instead as the electromagnetic relay 100 of the embodiment.

The case 5 includes: a case base portion 7 shaped almost like a rectangle; and a case cover 9 disposed to cover the case base portion 7, and to house mounted parts such as the driving block 2 and the contact block 3.

Figure 4:
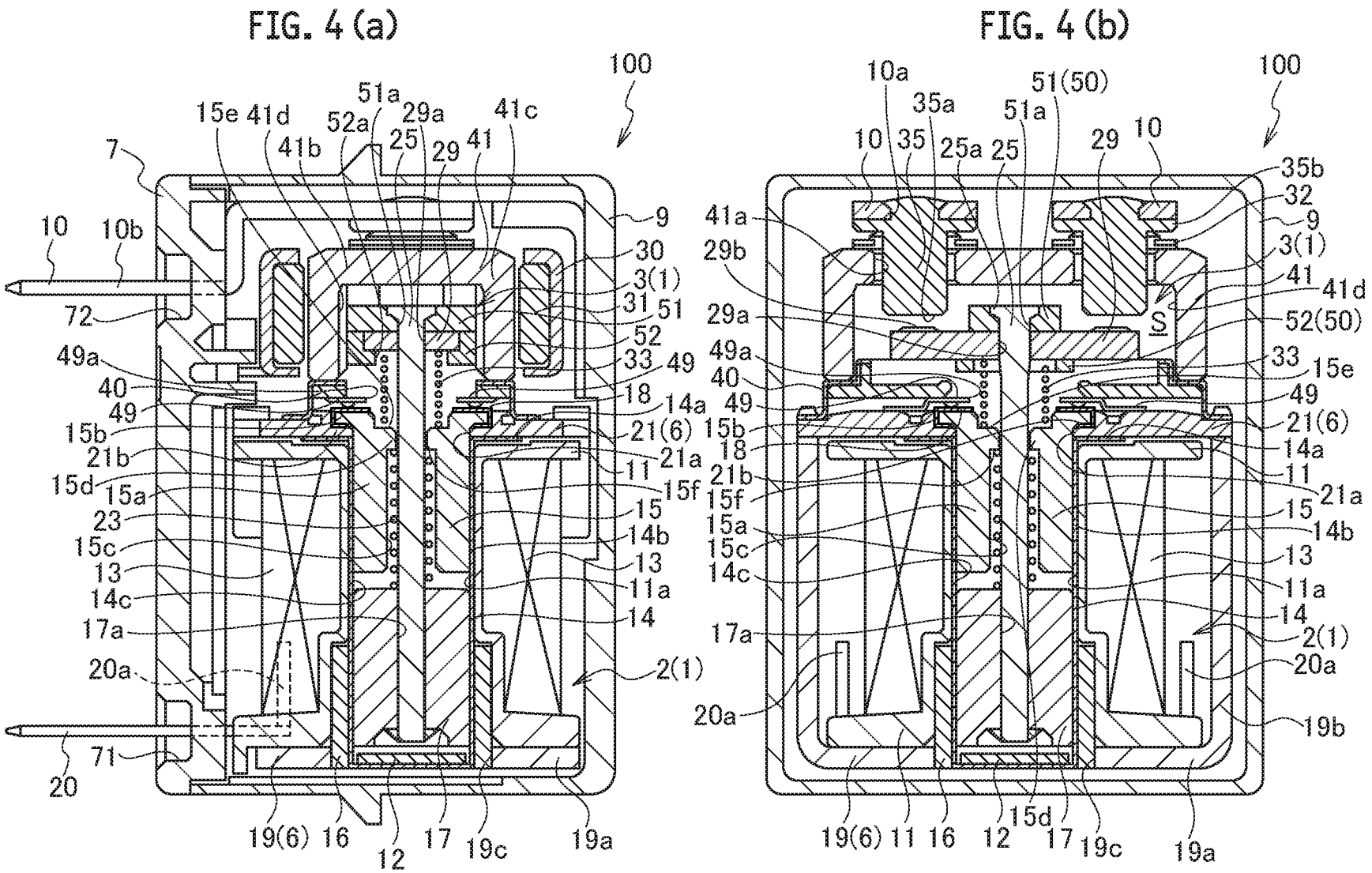
FIG. 4 shows the electromagnetic relay of the embodiment of the present invention.
Figure 5:
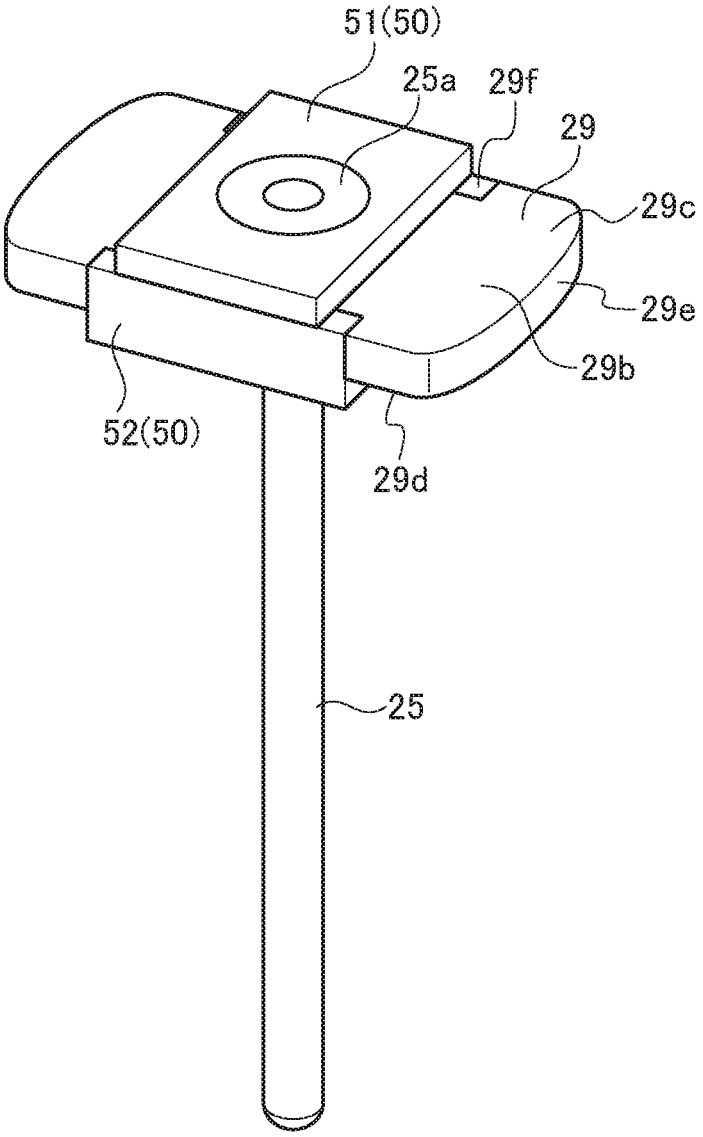
FIG. 5 is a perspective view schematically showing how a movable contactor and a yoke are attached to a driving shaft in the embodiment of the present invention.
Figure 6:
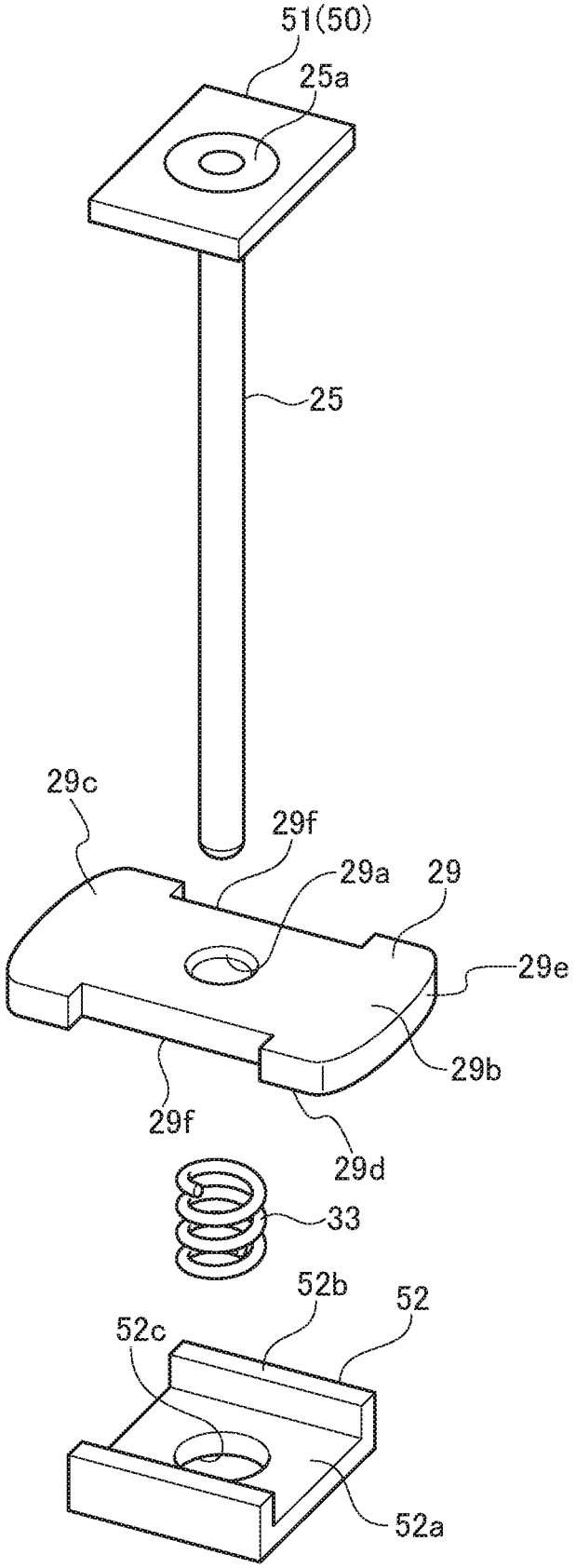
FIG. 6 is a perspective view showing components shown in FIG. 5 in a disassembled manner.
Figure 7:
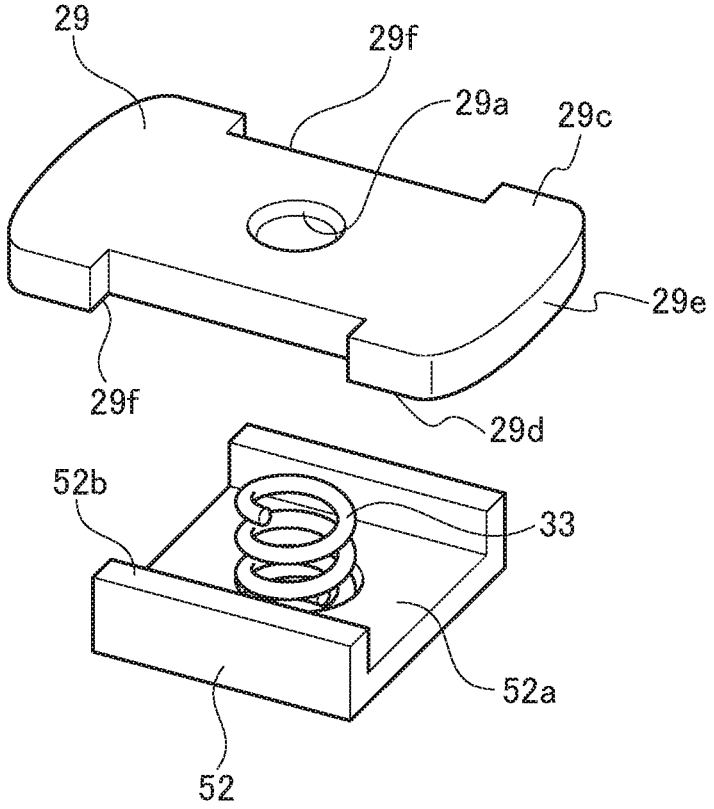
FIG. 7 is an exploded perspective view schematically showing the movable contactor, a lower yoke and a contact pressure spring of the embodiment of the present invention.

The case base portion 7 on a lower portion side in FIG. 4 is provided with a pair of slits 71, 71 through which a pair of coil terminals 20 are installed. In addition, the case base portion 7 on an upper portion side in FIG. 4 is provided with a pair of slits 72, 72 through which terminal portions 10*b*, 10*b* of a pair of main terminals 10, 10 are installed. On the other hand, the case cover 9 is shaped like a hollow box, which is opened on a side of the case base portion 7. Incidentally, the insertion holes 71 have almost the same shape as the cross section of the coil terminals 20, and the insertion holes 72 have almost the same shape as the cross section of the terminal portions 10*b*, 10*b* of the main terminals 10, 10.

The driving block 2 includes: a coil bobbin 11 shaped like a hollow cylinder with a coil 13 wound around the coil bobbin 11; and the pair of coil terminals 20 fixed to the coil bobbin 11 with two ends of the coil 13 connected to the coil terminals 20.

Two upper and lower ends of a cylindrical portion of the coil bobbin 11 are respectively provided with flange portions 11*c* shaped almost like a circle, and projecting in a circumferential direction. A winding cylindrical portion 11*d* around which to wind the coil 13 is formed between the upper and lower flange portions 11*c*.

The coil terminals 20 are made from electrically-conductive material such as copper, and shaped like a flat plate. The pair of coil terminals 20 are respectively provided with relay terminals 20*a*. Furthermore, lead lines of the two ends of the coil 13 wound around the coil bobbin 11 are welded to the relay terminals 20*a* with the lead lines wound around the relay terminals 20*a*.

In addition, the driving block 2 is designed to be driven when the coil 13 is electrified through the pair of coil terminals 20. When the driving block 2 is driven in this manner, contacts formed from fixed contacts 35*a* and movable contacts 29*b* of the contact block 3, which will be described later, are opened and closed. Thereby, a pair of fixed terminals 35 are switchable between electrical communication and electrical non-communication.

Furthermore, the driving block 2 includes a yoke 6 made from magnetic material, and surrounding the coil bobbin 11. In the embodiment, the yoke 6 is formed from: a rectangular yoke upper plate 21 in contact with an upper end surface of the coil bobbin 11; and a rectangular yoke 19 in contact with a lower end surface and a side surface of the coil bobbin 11. The yoke 6 is opened in the front-back direction.

The yoke 19 is disposed between the coil 13 and the case 5. The yoke 19 includes a bottom wall 19*a*, and a pair of side walls 19*b*, 19*b* rising from peripheral edges of the bottom wall 19*a*. In the embodiment, the bottom wall 19*a* and the pair of side walls 19*b*, 19*b* are continuously integrally formed by bending a plate. Moreover, an annular insertion hole 19*c* is formed in the bottom wall 19*a* of the yoke 19. A bush 16 made from magnetic material is installed through the insertion hole 19*c*. Besides, the yoke upper plate 21 is disposed on tip end sides (upper end sides) of the pair of side walls 19*b*, 19*b* of the yoke 19 in a way that the coil 13 wound around the coil bobbin 11 is covered with the yoke upper plate 21.

The driving block 2 further includes: a fixed iron core 15 fixed to a cylindrical inner portion of the coil bobbin 11 and magnetized by the coil 13 when the coil 13 is electrified; and a movable iron core 17 facing the fixed iron core 15 in a vertical direction (an axial direction) and disposed inside the cylinder of the coil bobbin 11. The fixed iron core 15 is shaped almost like a column. The fixed iron core 15 includes a projection 15*a* formed including an insertion hole 15*c*. An upper end of the projection 15*a* is provided with a flange portion 15*b* projecting in the circumferential direction.

In the embodiment, the driving block 2 further has a plunger cap 14 between the fixed iron core 15 and the coil bobbin 11 as well as between the movable iron core 17 and the coil bobbin 11. The plunger cap 14 is made from magnetic material, and shaped like an end-closed cylinder whose upper surface is opened. In this embodiment, the plunger cap 14 is disposed inside an insertion hole 11*a* formed in the center of the coil bobbin 11. When the plunger cap 14 is thus disposed, a flange portion 14*a* of the plunger cap 14 is placed on an annular seat surface 11*b* which is formed in an upper side of the coil bobbin 11. In addition, a protrusion 14*b* of the plunger cap 14 is fitted in the insertion hole 11*a*. Furthermore, the fixed iron core 15 and the movable iron core 17 are to be housed in the plunger cap 14 provided inside the cylinder of the coil bobbin 11. Incidentally, the fixed iron core 15 is disposed on an opening side of the plunger cap 14.

Moreover, the fixed iron core 15 and the movable iron core 17 are each shaped like a column such that their outer diameters are almost equal to an inner diameter of the plunger cap 14. The movable iron core 17 is designed to slide over the inner portion of the cylinder of the plunger cap 14. A range of movement of the movable iron core 17 is set between an initial position away from the fixed iron core 15 and a contact position where the movable iron core 17 is in contact with the fixed iron core 15. Besides, the return spring 23 is interposed between the fixed iron core 15 and the movable iron core 17. The return spring 23 is formed from a coil spring and configured to bias the movable iron core 17 in a direction in which the movable iron core 17 is returned to the initial position. The return spring 23 biases the movable iron core 17 in a direction in which the movable iron core 17 goes farther from the fixed iron core 15 (upward in FIG. 4). Incidentally, in the embodiment, a projection 15*d* is provided in the inside of the insertion hole 15*c* of the fixed iron core 15 such that the projection 15*d* extends along the full circumference of the insertion hole 15*c*, and projects toward the center of the insertion hole 15*c* to make the diameter of the hole smaller. A lower surface 15*f* of the projection 15*d* serves as a spring receiving portion for the return spring 23.

In addition, an insertion hole 21*a* through which to insert the fixed iron core 15 is penetratingly provided in a central portion of the yoke upper plate 21. The insertion of the fixed iron core 15 through the insertion hole 21*a* is achieved by inserting the cylindrical portion 15*b* of the fixed iron core 15 into the insertion hole 21*a* from the upper surface side of the yoke upper plate 21. The thus-inserted fixed iron core 15 is retained by fitting the flange portion 15*b* of the fixed iron core 15 to a recess 21*b* which is provided almost at the center of the upper surface of the yoke upper plate 21, and whose diameter is almost equal to that of the flange portion 15*b* of the fixed iron core 15.

Besides, a metal-made holding plate 49 is provided on a side of the upper surface of the yoke upper plate 21. The right and left end portions of the holding plate 49 are fixed to the upper surface of the yoke upper plate 21. The center of the holding plate 49 is provided with a projection so as to form a space for housing the flange portion 15*b* of the fixed iron core 15 which juts out from the upper surface of the yoke upper plate 21. Furthermore, in the embodiment, an iron core rubber 18 made from a material (for example, synthetic rubber) having rubber elasticity is provided between the fixed iron core 15 and the holding plate 49; and the core rubber 18 prevents direct propagation of vibrations from the fixed iron core 15 to the holding plate 49. The core rubber 18 is shaped like a disk, and an insertion hole 18*a* through which to insert a shaft (driving shaft) 25, which will be described later, is penetratingly provided in a central portion of the core rubber 18. Moreover, in the embodiment, the core rubber 18 is fittingly attached to the fixed iron core 15 so as to wrap the flange portion 15*b*.

The flange portion 14*a* projecting in the circumferential direction is formed on the opening side of the plunger cap 14, and is fixedly attached to the periphery of the insertion hole 21*a* in the lower surface of the yoke upper plate 21. A lower end bottom portion of the plunger cap 14 is inserted through the bush 16 installed in the insertion hole 19*c* of the bottom wall 19*a*. When the lower end bottom portion of the plunger cap 14 is inserted through the bush 16, the movable iron core 17 housed in the lower portion of the plunger cap 14 is magnetically joined to the peripheral portion of the bush 16.

When the coil 13 is electrified, this configuration makes a pair of magnetic pole portions, which are formed from a surface of the fixed iron core 15 facing the movable iron core 17 and a peripheral portion of the bottom wall 19*a* surrounding the bush 16, have mutually opposite polarities. Accordingly, the movable iron core 17 moves to the contact position by being attracted by the fixed iron core 15. On the other hand, once the electrification of the coil 13 is stopped, the return spring 23 returns the movable iron core 17 to the initial position. Incidentally, the return spring 23 is inserted through the insertion hole 15*c* of the fixed iron core 15 with the upper end of the return spring 23 in contact with the lower surface 15*f* of the projection 15*d*, and with the lower surface of the return spring 23 in contact with the upper surface of the movable iron core 17. Besides, in the embodiment, a bottom portion of the inside of the plunger cap 14 is provided with a dumper rubber 12 which is made from material having rubber elasticity, and whose diameter is almost equal to the outer diameter of the movable iron core 17.

The contact block 3 is provided above the driving block 2 to open and close the contacts depending on whether or not the coil 13 is electrified.

The contact block 3 is provided with a base 41 which is made from heat resistant material, and which is shaped like a box whose lower surface is opened. The bottom portion of the base 41 is provided with two insertion holes 41*a*. The pair of fixed terminals 35 are inserted through the insertion holes 41*a* with lower flanges 32 interposed in between, respectively. The fixed terminals 35 are each made from electrically-conductive material such as copper-based material, and shaped like a cylinder. The fixed contacts 35*a* are formed on the lower end surfaces of the fixed terminals 35. Flange portions 35*b* projecting in the circumferential direction are formed on the upper end portion of the fixed terminals 35. The centers of the flange portions 35*b* are provided with projections 35*c*. The upper surfaces of the lower flanges 32 and the flange portions 35*b* of the fixed terminals 35 are hermetically joined to each other using silver solders 34. The lower surfaces of the lower flanges 32 and the upper surface of the base 41 are hermetically joined to each other using silver solders 36 as well.

In addition, the pair of main terminals 10, 10 connected to external load or the like are attached to the fixed terminals 35. The main terminals 10, 10 are made from electrically-conductive material, and shaped like a flat plate. Intermediate portions of the main terminals 10, 10 in the front-back direction are bent in a stepped manner. Insertion holes 10*a*, 10*a* through which to insert the projections 35*c* of the fixed terminals 35 are formed in the front ends of the main terminals 10, 10. The main terminals 10, 10 are fixed to the fixed terminals 35 by spin-swaging the projections 35*c* inserted through the insertion holes 10*a*, 10*a*.

Furthermore, a movable contactor 29 is disposed inside the base 41 such that the movable contactor 29 extends from one to the other of the pair of fixed contacts 35*a*. Portions of the upper surface of the movable contactor 29 which face the fixed contacts 35*a* are provided with the movable contacts 29*b*, respectively. An insertion hole 29*a* through which to insert one end portion of the shaft 25 connecting the movable contactor 29 to the movable iron core 17 is penetratingly provided in a central portion of the movable contactor 29.

The shaft 25 is made from non-magnetic material, and includes: a bar-shaped shaft main body 25*b* elongated in the direction of the movement of the movable iron core 17 (the vertical direction); and a flange portion 25*a* formed on a portion of the shaft main body 25*b* which juts upward from the movable contactor 29 such that the flange portion 25*a* projects in the circumferential direction.

Moreover, an electrically-insulating plate 37 and a contact pressure spring (biasing portion) 33 are provided between the movable contactor 29 and the holding plate 49. The electrically-insulating plate 37 is made from electrically-insulating material, and formed covering the holding plate 49. The contact pressure spring 33 is formed from a coil spring, and the shaft 25 is inserted through the contact pressure spring 33. Incidentally, the center of the electrically-insulating plate 37 is provided with an insertion hole 37*a* through which to insert the shaft 25. The contact pressure spring 33 biases the movable contactor 29 in the upward direction (toward one side in the driving shaft direction).

In this respect, a positional relationship between the movable iron core 17 and the movable contactor 29 is set such that when the movable iron core 17 is in the initial position, the movable contacts 29*b* are away from the fixed contacts 35*a*, and such that when the movable iron core 17 is in the contact position, the movable contacts 29*b* are in contact with the fixed contacts 35*a*. In other words, while the coil 13 is not electrified, the contact device 3 is off, and the two fixed terminals 35 are electrically insulated from each other. While the coil 13 is being electrified, the contact block 3 is on, and the two fixed terminals 35 are electrically conductive to each other. Incidentally, the contact pressure spring 33 secures the contact pressure between the movable contacts 29*b* and the fixed contacts 35*a*.

Meanwhile, while the movable contacts 29*b* of the movable contactor 29 are in contact with the fixed contacts 35*a*, 35*a* to allow the flow of electric current, this electric current makes electromagnetic repulsive force act between the fixed contacts 35*a*, 35*a* and the movable contactor 29. The action of the electromagnetic repulsive force between the fixed contacts 35*a*, 35*a* and the movable contactor 29 decreases the contact pressure therebetween to increase the contact resistance therebetween and accordingly the Joule heat sharply, or makes the contacts therebetween become open to cause arc heat therebetween. These make it more likely that the movable contacts 29*b* and the fixed contacts 35*a* are welded to each other.

With this taken into consideration, the present embodiment is provided with a yoke 50 which, while the movable contacts 29*b* are in contact with the fixed contacts 35*a* (in the embodiment, while the power supply is on), is disposed at least on the lower side of the movable contactor 29 (on the opposite side in the driving shaft direction) (i.e., disposed in contact with a lower surface 29*d* of the movable contactor 29).

To put it concretely, the yoke 50 surrounding upper, lower and side surfaces 29*c*, 29*d*, 29*e* of the movable contactor 29 is formed from: an upper yoke (second yoke) 51 disposed on the upper side of the movable contactor 29; and a lower yoke (first yoke) 52 surrounding lower and side portions of the movable contactor 29. In other words, the yoke 50 is disposed at least on the lower side of the movable contactor 29 (on the opposite side in the driving shaft direction) (i.e., disposed in contact with the lower surface 29*d*), too, while the movable contacts 29*b* are away from the fixed contacts 35*a* (in the embodiment, while the power supply is off).

A magnetic circuit is formed between the upper yoke 51 and the lower yoke 52 by making the upper yoke 51 and the lower yoke 52 surround the movable contactor 29 in this manner.

Furthermore, provision of the upper yoke 51 and the lower yoke 52 realizes that, while the movable contacts 29*b* and the fixed contacts 35*a*, 35*a* are in contact with each other to allow the flow of the electric current, the upper yoke 51 and the lower yoke 52 produce mutually-attracting magnetic force on the basis of the electric current. The production of the mutually-attracting magnetic force like this makes the upper yoke 51 and the lower yoke 52 attract each other. The attraction between the upper yoke 51 and the lower yoke 52 makes the fixed contacts 35*a* press the movable contactor 29, and accordingly restricts the movement of the movable contactor 29 to separate from the fixed contacts 35*a*. Since the movement of the movable contactor 29 to separate from the fixed contacts 35*a* is restricted in this manner, the movable contacts 29*b* are attracted to the fixed contacts 35*a* without the movable contactor 29 repelling the fixed contacts 35*a*. Accordingly, the occurrence of the arc is inhibited. As a result, it is possible to inhibit the contacts from being welded to each other due to the occurrence of the arc.

Moreover, in the embodiment, the upper yoke 51 is shaped almost like a rectangular plate; and the lower yoke 52 includes a bottom wall portion 52*a*, and side wall portions 52*b* formed to rise from two ends of the bottom wall portion 52*a*, such that the bottom wall portion 52*a* and the side wall portions 52*b* make the lower yoke 52 shaped almost like the letter U. In this respect, it is desirable that, as shown in FIG. 4(*a*), the upper end surfaces of the side wall portions 52*b* of the lower yoke 52 be in contact with the lower surface of the upper yoke 51. However, the upper end surfaces of the side wall portions 52*b* of the lower yoke 52 do not have to be in contact with the lower surface of the upper yoke 51.

In addition, in the embodiment, the contact pressure spring 33 biases the movable contactor 29 in the upper direction. To put it concretely, the upper end of the contact pressure spring 33 is in contact with the lower surface 29*d* of the movable contactor 29, while the lower end of the contact pressure spring 33 is in contact with an upper surface 15*e* of the projection 15*d*. In this manner, in the embodiment, the upper surface 15*e* of the projection 15*d* serves as a spring receiving portion for the contact pressure spring 33.

Furthermore, the insertion holes 51*a*, 52*c* and 49*a* in which to insert the shaft 25 are respectively formed in the upper yoke 51, the lower yoke 52 and the holding plate 49.

Moreover, as described below, the movable contactor 29 is attachable to the one end portion of the shaft 25.

To begin with, the movable iron core 17, the return spring 23, the yoke upper plate 21, the fixed iron core 15, the core rubber 18, the holding plate 49, the electrically-insulating plate 37, the contact pressure spring 33, the lower yoke 52, the movable contactor 29 and the upper yoke 51 are disposed in this order from the bottom. When these components are thus disposed, the return spring 23 is inserted through: the insertion hole 21*a* of the yoke upper plate 21; and the insertion hole 15*c* of the fixed iron core 15 whose projection 15*a* is fitted in an insertion hole 14*c* of the plunger cap 14.

Thereafter, from the upper side of the upper yoke 51, the main body 25*b* of the shaft 25 is inserted through the insertion holes 51*a*, 29*a*, 52*c*, 37*a*, 49*a*, 18*a*, 15*c*, 21*a*, the contact pressure spring 33, the return spring 23 and an insertion hole 17*a* of the movable iron core 17. Subsequently, the shaft 25 is connected to the movable iron core 17. In the embodiment, the fastening of the shaft 25 to the movable iron core 17 is performed by squeezing the tip end of the shaft 25 which is used as a rivet, as shown in FIG. 4. Incidentally, the shaft 25 may be instead fastened to the movable iron core 17 by: forming a thread groove in the other end portion of the shaft 25; and screwing the shaft 25 to the movable iron core 17.

In this manner, the movable contactor 29 is attached to the one end portion of the shaft 25. In the embodiment, an annular seat surface 51*b* is formed on the upper side of the upper yoke 51. The shaft 25 is retained with its upper projection inhibited by housing the flange portion 25*a* of the shaft 25 in the seat surface 51*b*. Incidentally, the shaft 25 may be instead fixed to the upper yoke 51 by laser welding or the like.

Furthermore, the inner diameter of the insertion hole 15*c* provided in the fixed iron core 15 is set larger than the outer diameter of the shaft 25 such that the shaft 25 at least does not contact the fixed iron core 15. This configuration makes the movable contactor 29 move in the vertical direction in response to the movement of the movable iron core 17.

Moreover, in the embodiment, the base 41 is filled with a gas in order to inhibit the arc from occurring between the movable contacts 29*b* and the fixed contacts 35*a* when the movable contacts 29*b* are brought away from the fixed contacts 35*a*. As such a gas, a mixed gas mainly containing a hydrogen gas may be used because the hydrogen gas is the best in thermal conductivity in a temperature range where the arc is most likely to occur. In the embodiment, an upper flange 40 configured to cover a gap between the base 41 and the yoke upper plate 21 is provided in order to seal the gas in the base 41.

To put it concretely, the base 41 includes: a top wall 41*b* provided with the pair of insertion holes 41*a* arranged side-by-side; and a prism-shaped wall portion 41*c* rising from the peripheral edge of the top wall 41*b*. The base 41 is formed like a hollow box whose lower side (on the side of the movable contactor 29) is opened. With the movable contactor 29 housed inside the wall portion 41*c* from the opened lower side, the base 41 is fixed to the yoke upper plate 21 with the upper flange 40 interposed in between.

In the embodiment, the peripheral edge portion of the opening in the lower surface of the base 41 is hermetically joined to the upper surface of the upper flange 40 with silver solder 38, while the lower surface of the upper flange 40 is hermetically joined to the upper surface of the yoke upper plate 21 by arc welding or the like. In addition, the lower surface of the yoke upper plate 21 is hermetically joined to the flange portion 14*a* of the plunger cap 14 by arc welding or the like. Thereby, a sealed space S filled with the gas is formed inside the base 41.

Furthermore, the embodiment inhibits the arc using a capsule yoke while performing the arc inhibiting method using the gas. The capsule yoke is formed from a magnetic member 30 and a pair of permanent magnets 31. The magnetic member 30 is made from a magnetic material such as iron, and shaped almost like the letter U. The magnetic member 30 is integrally formed from a pair of mutually-facing side pieces 30*a*, and a connecting piece 30*b* connecting base end portions of the respective side pieces 30*a*.

The permanent magnets 31 are attached to the two side pieces 30*a* of the magnetic member 30 so as to face both side pieces 30*a*. The permanent magnets 31 give the base 41 a magnetic field extending almost orthogonal to the direction in which the movable contacts 29*a* come into and out of contact with the fixed contacts 35*a*. Thereby, the arc is elongated in a direction orthogonal to the direction of the movement of the movable contactor 29, and is concurrently cooled by the gas filled in the base 41. When the arc voltage sharply rises to exceed the voltage between the contacts, the arc is interrupted. In other words, in the electromagnetic relay 100 of the embodiment, the measure to counter the arc is achieved by: making the capsule yoke magnetically blow out the arc; and cooling the arc with the gas filled in the base 41. Thereby, the arc can be interrupted in a short length of time, while the fixed contacts 35*a* and the movable contacts 29*b* can be less consumed.

Meanwhile, in the electromagnetic relay 100 of the embodiment, since the plunger cap 14 guides the movable iron core in its movement direction (in the vertical direction), restrictions are imposed on the position of the movable iron core 17 in a plane orthogonal to the movement direction of the movable iron core 17. For this reason, restrictions are also imposed on the position of the shaft 25 connected to the movable iron core 17 in the plane orthogonal to the movement direction of the movable iron core 17. Furthermore, in the embodiment, since the shaft 25 is inserted through the insertion hole 15*c* of the fixed iron core 15, restrictions are imposed on the position of the shaft 25 in the plane orthogonal to the movement direction of the movable iron core 17. In other words, the insertion hole 15*c* of the fixed iron core 15 is formed such that the inner diameter of a portion of the insertion hole 15*c* on which the projection 15*d* is formed is almost equal to the outer diameter of the shaft 25. That is to say, the inner diameter of the insertion hole 15*c* is set large enough to allow the shaft 25 to move in the vertical direction while restricting the forward, backward, leftward and rightward movement of the shaft 25.

Due to such configuration, the shaft 25 is to be restricted at two components, that is to say, the plunger cap 14 and the projection 15*d* of the fixed iron core 15, from tilting toward the movement direction of the movable iron core 17. For this reason, even when the shaft 25 becomes more likely to tilt toward the movement direction of the movable iron core 17, the position of the shaft 25 in the plane orthogonal to the movement direction of the movable iron core 17 is restricted by the two components, that is to say, the lower end of the movable iron core 17 and the projection 15*d* of the fixed iron core 15. Thereby, the tilt of the shaft 25 is restricted. As a result, the shaft 25's ability to move straight can be secured, and the tilt of the shaft 25 can be inhibited.

Next, descriptions will be provided for how the contact device 1 works.

First of all, while the coil 13 is not electrified, the elastic force of the return spring 23 is greater than the elastic force of the contact pressure spring 33. For this reason, the movable iron core 17 moves in the direction of going away from the fixed iron core 15. Accordingly, the movable contacts 29*b* are put in a state shown in FIGS. 4(*a*) and 4(*b*) where the movable contacts 29*b* are away from the fixed contacts 35*a*.

Once the coil 13 is electrified in this off state, electromagnetic force is generated, and the movable iron core 17 thereby moves closer to the fixed iron core 15 by being attracted by the fixed iron core 15 against the elastic force of the return spring 23. In response to the upward movement of the movable iron core 17 (toward the fixed iron core 15), the shaft 25, as well as the upper yoke 51, the movable contactor 29 and the lower yoke 52 attached to the shaft 25, moves upward (toward the fixed contacts 35*a*). Thereby, the movable contacts 29*b* of the movable contactor 29 come into contact with the fixed contacts 35*a* of the fixed terminals 35. Accordingly, electrical communication is established between the contacts, and the contact device 1 is turned on.

Meanwhile, according to the above-mentioned conventional technique, the contact pressure spring biases the movable contactor via the lower yoke toward one end of the driving shaft. Since the contact pressure spring is thus configured to bias the movable contactor by pressing the lower yoke provided on the lower side of the movable contactor, the placement position of the contact pressure spring is limited to the lower surface of the lower yoke.

In this respect, the embodiment makes it possible to achieve a further increase in freedom of layout of the contact pressure spring (biasing portion) 38 configured to bias the movable contactor 29.

With the above taken into consideration, an object of the present invention is to obtain a contact device, and an electromagnetic relay mounted with the contact device, which both achieve an increase in the freedom of layout of the biasing portion configured to bias the movable contactor.

To put it concretely, the contact pressure spring (biasing portion) 33 includes a biasing end configured to make upward biasing force (toward the one side in the driving shaft direction) act on the movable contactor 29 by pressing a member other than the yoke 50.

In other words, the biasing end of the contact pressure spring (biasing portion) 33 is configured to make the upward biasing force act on the movable contactor 29 by pressing a member other than the yoke 50, instead of by directly pressing the yoke 50.

In the embodiment, an upper end 33*a* of the contact pressure spring (biasing portion) 33 corresponds to the biasing end. Furthermore, the contact pressure spring (biasing portion) 33 is configured to directly bias the movable contactor 29 by making the upper end (biasing end) 33*a* directly press the lower surface 29*d* of the movable contactor 29 (a member other than the yoke 50).

It should be noted that the upper end (biasing end) 33*a* of the contact pressure spring (biasing portion) 33 may be configured to indirectly press the yoke 50 upward as long as the upper end (biasing end) 33*a* thereof does not directly press the yoke 50 upward (toward the one side in the driving shaft direction, or toward the movable contactor 29). In other words, the upper end (biasing end) 33*a* of the contact pressure spring (biasing portion) 33 may be configured to press the member other than the yoke 50 such that the member other than the yoke 50 resultantly presses the axially opposite surface of the yoke 50 toward the one side in the driving shaft direction.

Moreover, in the embodiment, the contact device 1 can be reduced in size in its height direction (the vertical direction, or the driving shaft direction).

To put it concretely, the upper end (biasing end) 33*a* of the contact pressure spring (biasing portion) 33 is located higher than a lower surface (a surface of the yoke 50 on the opposite side in the driving shaft direction) 52*d* of the lower yoke (first yoke) 52 (i.e., located on the one side in the driving shaft direction, or closer to the movable contactor 29).

Figure 8A:
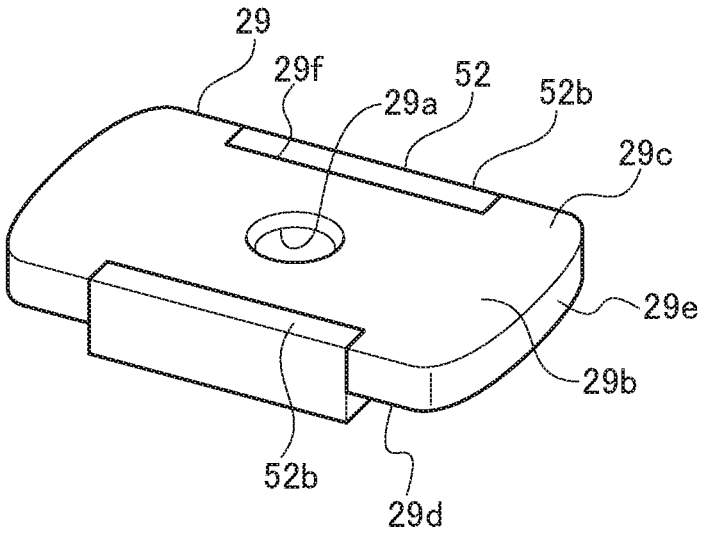
FIG. 8 schematically shows a method of fixing the movable contactor and the lower yoke in the embodiment of the present invention.
Figure 8B:
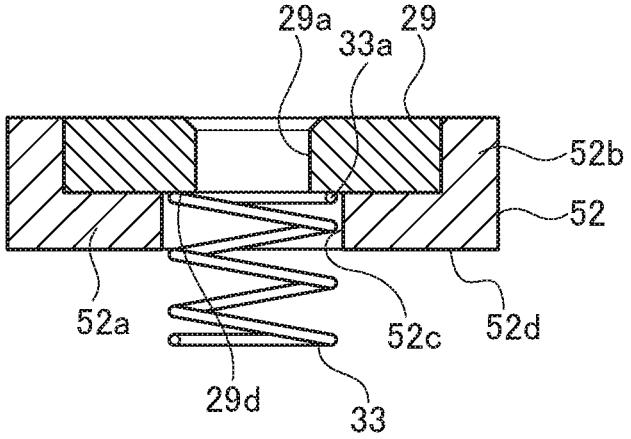

In the embodiment, as shown in FIG. 8(*b*), the diameter of the insertion hole 52*c* of the lower yoke 52 is made larger than the diameter of the insertion hole 29*a* of the movable contactor 29 and the diameter of the shaft 25, while the insertion hole 52*c* and the insertion hole 29*a* are disposed coaxial with each other. Furthermore, the upper portion of the contact pressure spring (biasing portion) 33 is inserted through a gap between the insertion hole 52*c* and the shaft 25, and the upper end (biasing end) 33*a* is put in contact with the lower surface 29*d* of the movable contactor 29 (a portion of the lower surface 29*d* which does not coincide with the lower yoke 52 when viewed from under).

In the embodiment, in this manner, the lower yoke 52 includes at least the insertion hole (hole portion) 52*c* formed to penetrate the lower yoke 52 in the driving shaft direction, and the upper end (biasing end) 33*a* of the contact pressure spring (biasing portion) 33 is housed in the insertion hole (hole portion) 52*c*.

Thereby, the upper end (biasing end) 33*a* of the contact pressure spring (biasing portion) 33 makes the upward biasing force act on the movable contactor 29 without being in contact with the lower yoke 52 (the yoke 50) (i.e., without the yoke interposed between the upper end (biasing end) 33*a* and the movable contactor 29). In other words, in the embodiment, the contact pressure spring (biasing portion) 33 biases the movable contactor 29 upward directly without the lower yoke 52 (the yoke 50) interposed in between.

It should be noted that it suffices if the upper end (biasing end) 33*a* is not in contact with the lower yoke 52 (the yoke 50) in the vertical direction (the driving shaft direction). In other words, the expression stating "without being in contact with the lower yoke 52 (the yoke 50)" does not mean that the expression excludes, for example, a configuration in which the positional displacement of the contact pressure spring (biasing portion) 33 in the lateral direction brings the upper end (biasing end) 33*a* into contact with the side surface of the lower yoke 52 (the yoke 50) (i.e., the inner peripheral surface of the insertion hole 52*c*).

Moreover, in the embodiment, the lower yoke (first yoke) 52 and the movable contactor 29 are fixed to each other using press-fitting means as fixing means.

To put it concretely, the lower yoke (first yoke) 52 and the movable contactor 29 are fixed to each other by press-fitting the side wall portions (press-fitting portions) 52*b* formed in the lower yoke 52, which is at least one of the lower yoke 52 and the movable contactor 29, to cutouts (press-fitted portions) 29*f* formed in the movable contactor 29 which is the other of the lower yoke 52 and the movable contactor 29.

In the embodiment, the side wall portions 52*b* as the press-fitting portions correspond to press-fitting projections. The configuration of the embodiment is made such that the press-fitting portions include the press-fitting projections formed on at least one of the lower yoke (first yoke) 52 and the movable contactor 29.

Besides, in the embodiment, the lower yoke (first yoke) 52 is formed to include the bottom wall portion 52*a*, and the side wall portions 52*b* rising from the two ends of the bottom wall portion 52*a*, which are formed by bending the two ends of the plate-shaped member upward in the same direction.

In other words, the side wall portions 52*b* of the embodiment correspond to upward-bent portions. For this reason, the configuration of the embodiment is also made such that the press-fitting projections include the upward-bent portions formed on at least one of the lower yoke (first yoke) 52 and the movable contactor 29.

It should be noted that insertion holes or insertion recesses in which to insert the side wall portions 52*b* by press-fitting may be formed in the movable contactor 29. Otherwise, press-fitting projections such as upward-bent portions may be formed on the movable contactor 29. Instead, press-fitting projections such as upward-bent portions may be formed on both the lower yoke (first yoke) 52 and the movable contactor 29, and press-fitted portions such as cutouts, insertion holes or insertion recesses may be formed in positions on both the lower yoke (first yoke) 52 and the movable contactor 29 which correspond to the press-fitting projections.

As explained above, in the embodiment, the contact pressure spring (biasing portion) 33 includes the upper end (biasing end) 33*a* configured to make the upward biasing force act on the movable contactor 29 by directly pressing the movable contactor 29 which is a member other than the yoke 50.

Because of the configuration in which, as described above, the upper end (biasing end) 33*a* of the contact pressure spring (biasing portion) 33 presses the member (in the embodiment, the movable contactor 29) other than the yoke 50, it is possible to achieve a further increase in freedom of layout of the contact pressure spring (biasing portion) 33 configured to bias the movable contactor 29.

Furthermore, in the embodiment, the contact pressure spring (biasing portion) 33 includes the upper end (biasing end) 33*a* located higher than the lower surface (the surface of the yoke 50 on the opposite side in the driving shaft direction) 52*d* of the lower yoke (first yoke) 52 (i.e., located on the one side in the driving shaft direction), and configured to make the upward biasing force act on the movable contactor 29 without being in contact with the lower yoke 52 (the yoke 50) (i.e., without the yoke interposed in between). In other words, the upper end (biasing end) 33*a* of the contact pressure spring (biasing portion) 33 is located higher than the lower surface (the surface of the yoke 50 on the opposite side in the driving shaft direction) 52*d* of the lower yoke (first yoke) 52 (i.e., located on the one side in the driving shaft direction, or closer to the movable contactor 29).

As a result, the contact device 1 can be reduced in size in its height direction (the vertical direction, or the driving shaft direction).

Moreover, in the embodiment, the contact pressure spring (biasing portion) 33 biases the movable contactor 29 upward directly without the lower yoke 52 (the yoke 50) interposed in between. For this reason, the height of the contact device 1 can be made smaller by the thickness of the lower yoke (first yoke) 52 than in a case where the upper end (biasing end) 33*a* of the contact pressure spring (biasing portion) 33 is in contact with the lower yoke (first yoke) 52.

Simultaneously, the movable contactor 29 can be reduced in weight since the movable contactor 29 is shaped like a plate, and since the upper and lower surfaces 29*c*, 29*d* of the plate-shaped movable contactor 29 are each formed as a flat surface. The lighter weight of the movable contactor 29 like this makes it possible to increase the contact opening speed. The increased contact opening speed makes it possible to quicken the interruption, and accordingly to extend the life of the contact device 1.

Besides, in the embodiment, the upper end (biasing end) 33*a* of the contact pressure spring (biasing portion) 33 is inserted through the insertion hole (hole portion) 52*c* formed in the lower yoke 52, and at least penetrating the lower yoke 52 in the driving shaft direction. For this reason, the positional displacement of the contact pressure spring (biasing portion) 33 can be inhibited by the insertion hole 52*c* and can make the upper biasing force more stably act on the movable contactor 29.

In addition, in the embodiment, the lower yoke (first yoke) 52 and the movable contactor 29 are fixed to each other using the fixing means. As a result, the positional displacement of the lower yoke (first yoke) 52 relative to the movable contactor 29 is inhibited. For this reason, it is possible to more securely restrict the movable contactor 29 from going away from the fixed contacts 35*a*.

Furthermore, in the embodiment, the lower yoke (first yoke) 52 and the movable contactor 29 are fixed to each other using the press-fitting means as the fixing means. For this reason, the lower yoke (first yoke) 52 can be fixed to the movable contactor 29 while being aligned to the movable contactor 29.

Moreover, since the lower yoke (first yoke) 52 and the movable contactor 29 are fixed to each other by press-fitting the side wall portions 52*b* as the upward-bent portions to the cutouts (press-fitted portions) 29*f*, the fixing positions are easy to recognize, and the fixing work is easier to perform.

It should be noted that: the fixing means for fixing the lower yoke (first yoke) 52 and the movable contactor 29 is not limited to what has been discussed above; but various fixing means are usable.

For example, the fixing can be achieved using methods shown in FIGS. 9 to 19. Even such configurations can bring about the same operation/working-effect as the foregoing embodiment.

Figure 9:
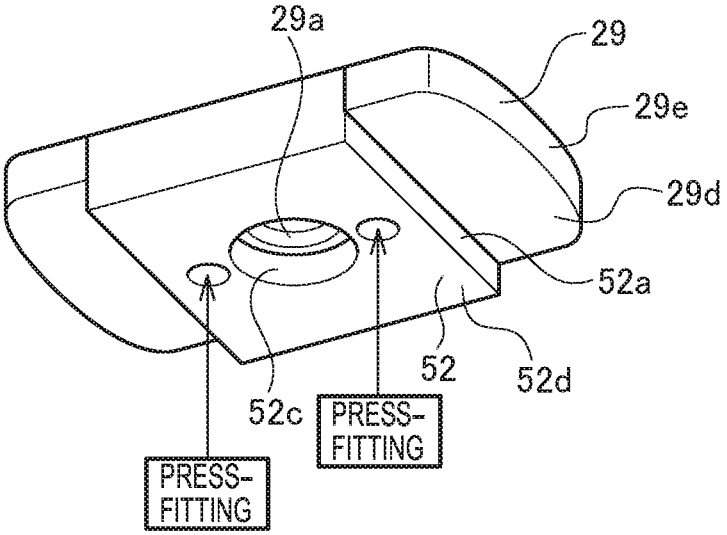
FIG. 9 schematically shows a first modification of the method of fixing the movable contactor and the lower yoke.
Figure 9:
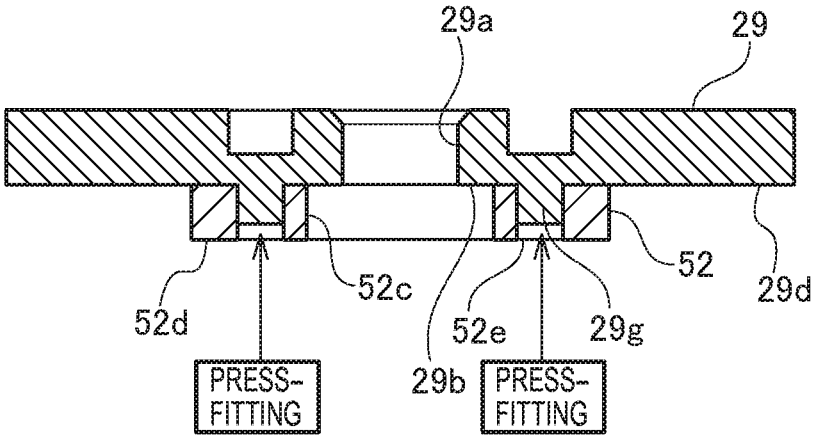

In FIG. 9, the lower yoke (first yoke) 52 and the movable contactor 29 are fixed to each other using press-fitting means as the fixing means.

To put it concretely, the lower yoke (first yoke) 52 and the movable contactor 29 are press-fitting fixed (attached firmly) to each other by press-fitting projections (press-fitting projections) 29*g* formed on the lower surface 29*d* of the movable contactor 29 to insertion holes (press-fitted portions) 52*e* formed in the bottom wall portion 52*a* of the lower yoke (first yoke) 52. This configuration also makes it easy to recognize the fixing positions, and accordingly, makes it possible to perform the fixing work more easily.

It should be noted that the projections (press-fitting portions) 29*g* on the movable contactor 29 shown in FIG. 9 are formed by dowel formation processing. In addition, although FIG. 9 shows an example of the movable contactor 29 on which the two projections (press-fitting portions) 29*g* are formed, the number of projections (press-fitting portions) 29*g* may be one, three, or more.

Figure 10A:
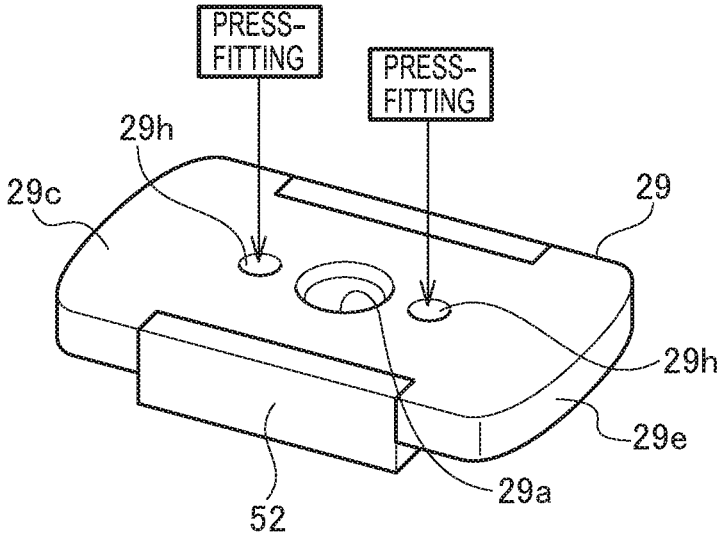
FIG. 10 schematically shows a second modification of the method of fixing the movable contactor and the lower yoke.
Figure 10B:
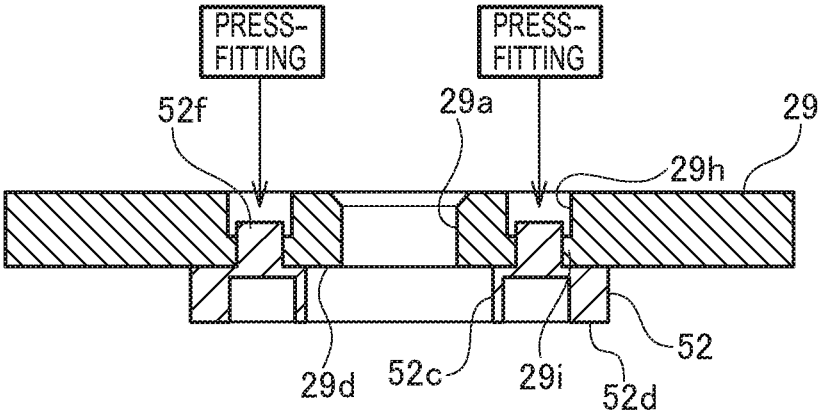

In FIG. 10, the lower yoke (first yoke) 52 and the movable contactor 29 are fixed to each other using press-fitting means as the fixing means.

To put it concretely, the lower yoke (first yoke) 52 and the movable contactor 29 are press-fitting fixed (attached firmly) to each other by press-fitting projections (press-fitting projections) 52*f* formed on the bottom wall portion 52*a* of the lower yoke (first yoke) 52 to insertion holes (press-fitted portions) 29*h* formed in the movable contactor 29. This configuration also makes it easy to recognize the fixing positions, and accordingly, makes it possible to perform the fixing work more easily.

The projections (press-fitting projections) 52*f* on the lower yoke (first yoke) 52 shown in FIG. 10 are formed by dowel formation processing. In addition, the insertion holes (press-fitted portions) 29*h* respectively include steps 29*i* formed thereon. Incidentally, although FIG. 10 shows an example of the lower yoke (first yoke) 52 on which two projections (press-fitting projections) 52*f* are formed, the number of projections (press-fitting projections) 52*f* may be one, three, or more.

Furthermore, FIGS. 9 and 10 show examples where the press-fitting portions (press-fitting projections) are formed on either the lower yoke (first yoke) 52 or the movable contactor 29. Instead, however, the press-fitting portions (press-fitting projections) may be formed on both the lower yoke (first yoke) 52 and the movable contactor 29.

Figure 11A:
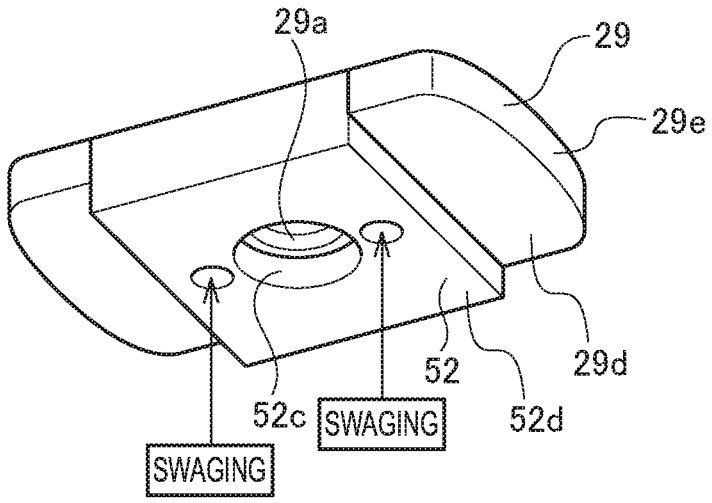
FIG. 11 schematically shows a third modification of the method of fixing the movable contactor and the lower yoke.
Figure 11B:
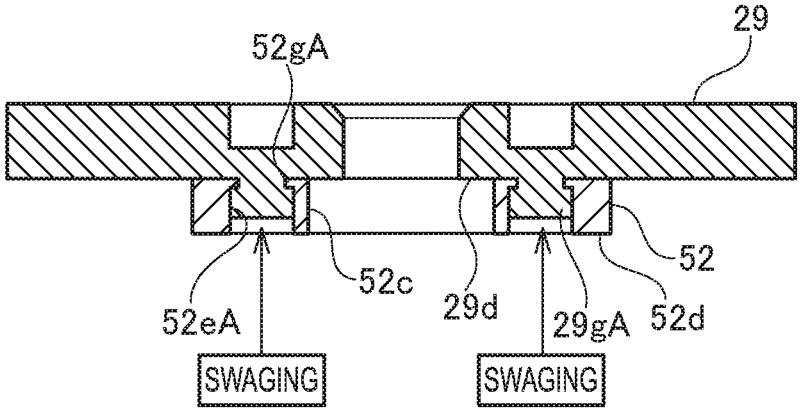

In FIG. 11, the lower yoke (first yoke) 52 and the movable contactor 29 are fixed to each other using swaging means as the fixing means.

To put it concretely, the lower yoke (first yoke) 52 and the movable contactor 29 are swaging-fixed (attached firmly) to each other by swaging projections (swaging projections) 29*g*A formed on the lower surface 29*d* of the movable contactor 29 with the projections (swaging projections) 29*g*A inserted (in the embodiment, press-fitted) in insertion holes (swaged portions) 52*e*A formed in the bottom wall portion 52*a* of the lower yoke (first yoke) 52. This configuration makes it possible to perform the fixing by swaging with the lower yoke (first yoke) 52 and the movable contactor 29 aligned to each other using the projections (swaging projections) 29*g*A, and thereby to facilitate the fixing work.

Furthermore, the projections (swaging projections) 29*g*A on the movable contactor 29 shown in FIG. 11 are formed by dowel formation processing as well. In addition, as shown in FIG. 11, the insertion holes (swaged portions) 52*e*A respectively include steps 52*g*A formed thereon such that after being swaged, the resultantly deformed projections (swaging projections) 29*g*A are brought into engagement with the steps 52*g*A. Thereby, their retaining strength after the swaging can be increased, and the separation between the lower yoke (first yoke) 52 and the movable contactor 29 can be more securely inhibited.

It should be noted that although FIG. 11 shows an example of the movable contactor 29 on which two projections (press-fitting projections) 29*g*A are formed, the number of projections (swaging projections) 29*g*A may be one, three, or more.

Figure 12:
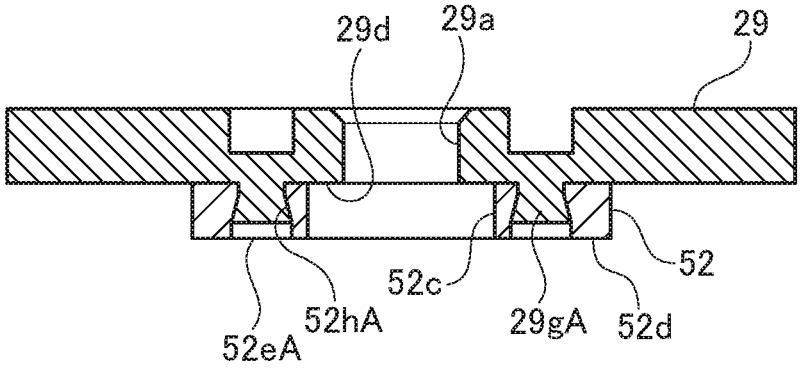
FIG. 12 is a cross-sectional view schematically showing a fourth modification of the method of fixing the movable contactor and the lower yoke.

In FIG. 12, the lower yoke (first yoke) 52 and the movable contactor 29 are fixed to each other using swaging means as the fixing means.

To put it concretely, the lower yoke (first yoke) 52 and the movable contactor 29 are swaging-fixed (attached firmly) to each other by swaging the projections (swaging projections) 29*g*A formed on the lower surface 29*d* of the movable contactor 29 with the projections (swaging projections)

29*g*A inserted (in the embodiment, press-fitted) in the insertion holes (swaged portions) 52*e*A formed in the bottom wall portion 52*a* of the lower yoke (first yoke) 52. To this end, tapered portions 52*h*A whose diameters become gradually larger toward their lower sides are formed in the insertion holes (swaged portions) 52*e*A, respectively, such that, after being swaged, the outer peripheral surfaces of the resultantly deformed projections (swaging projections) 29*g*A are brought into engagement with the tapered portions 52*h*A. Thereby, their retaining strength after the swaging can be increased, and the separation between the lower yoke (first yoke) 52 and the movable contactor 29 can be more securely inhibited.

It should be noted that the projections (swaging projections) 29*g*A on the movable contactor 29 shown in FIG. 12 are formed by dowel formation processing as well. In addition, although FIG. 12 shows an example of the movable contactor 29 on which two projections (swaging projections) 29*g*A are formed, the number of projections (swaging projections) 29*g*A may be one, three, or more.

Furthermore, although FIGS. 11 and 12 show examples where either the steps 52*g*A or the tapered portions 52*h*A are formed in the insertion holes (swaged portions) 52*e*A, both the steps 52*g*A and the tapered portions 52*h*A may be formed in the insertion holes (swaged portions) 52*e*A. Otherwise, neither the steps 52*g*A nor the tapered portions 52*h*A may be formed in the insertion holes (swaged portions) 52*e*A. In addition, the swaging may be performed with the projections (swaging projections) 29*g*A only inserted in the insertion holes (swaged portions) 52*e*A instead of press-fitting the projections (swaging projections) 29*g*A in the insertion holes (swaged portions) 52*e*A.

Figure 13A:
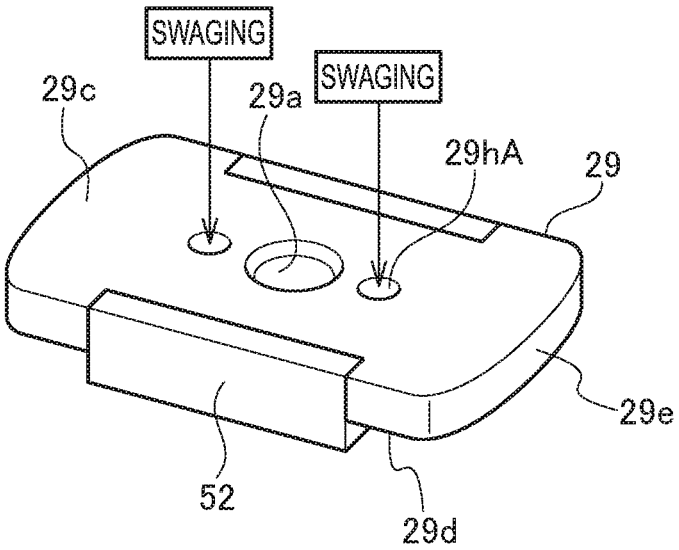
FIG. 13 schematically shows a fifth modification of the method of fixing the movable contactor and the lower yoke.
Figure 13B:
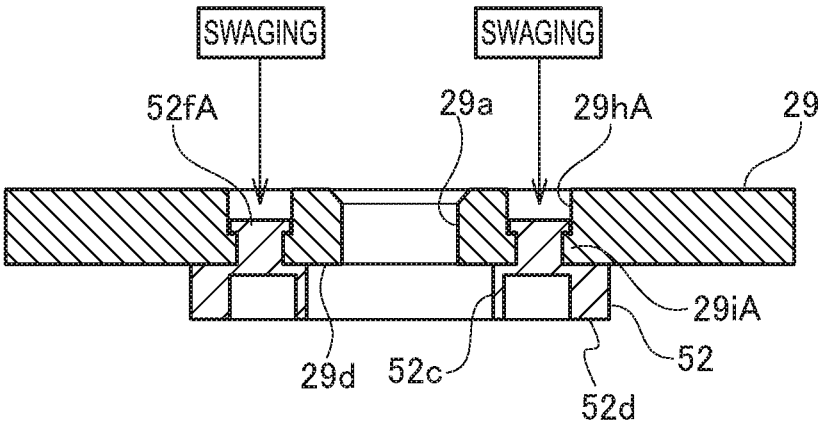

In FIG. 13, the lower yoke (first yoke) 52 and the movable contactor 29 are fixed to each other using swaging means as the fixing means.

To put it concretely, the lower yoke (first yoke) 52 and the movable contactor 29 are swaging-fixed (attached firmly) to each other by swaging projections (swaging projections) 52*f*A formed on the bottom wall portion 52*a* of the lower yoke (first yoke) 52 with the projections (swaging projections) 52*f*A inserted (in the embodiment, press-fitted) in insertion holes (swaged portions) 29*h*A formed in the movable contactor 29. This configuration makes it possible to perform the fixing by swaging with the lower yoke (first yoke) 52 and the movable contactor 29 aligned to each other using the projections (swaging projections) 52*f*A, and thereby to facilitate the fixing work.

In addition, the projections (swaging projections) 52*f*A on the lower yoke (first yoke) 52 shown in FIG. 13 are formed by dowel formation processing as well. Furthermore, as shown in FIG. 13, the insertion holes (swaged portions) 29*h*A respectively include steps 29*i*A formed thereon such that after being swaged, the resultantly deformed projections (swaging projections) 52*f*A are brought into engagement with the steps 29*i*A. Thereby, their retaining strength after the swaging can be increased, and the separation between the lower yoke (first yoke) 52 and the movable contactor 29 can be more securely inhibited.

It should be noted that although FIG. 13 shows an example of the lower yoke (first yoke) 52 on which two projections (swaging projections) 52*f*A are formed, the number of projections (swaging projections) 52*f*A may be one, three, or more. Moreover, instead of the steps 29*i*A, tapered portions may be formed in the insertion holes (swaged portions) 29*h*A. Otherwise, in addition to the steps 29*i*A, tapered portions may be formed in the insertion holes (swaged portions) 29*h*A. Besides, neither the steps 29*i*A nor the tapered portions may be formed in the insertion holes (swaged portions) 29*h*A. In addition, the swaging may be performed with the projections (swaging projections) 52*f*A only inserted in the insertion holes (swaged portions) 29*h*A instead of press-fitting the projections (swaging projections) 52*f*A in the insertion holes (swaged portions) 29*h*A.

Furthermore, FIGS. 11 to 13 show examples where the swaging portions (swaging projections) are formed on either the lower yoke (first yoke) 52 or the movable contactor 29. Instead, however, the swaging portions (swaging projections) may be formed on both the lower yoke (first yoke) 52 and the movable contactor 29.

Figure 14:
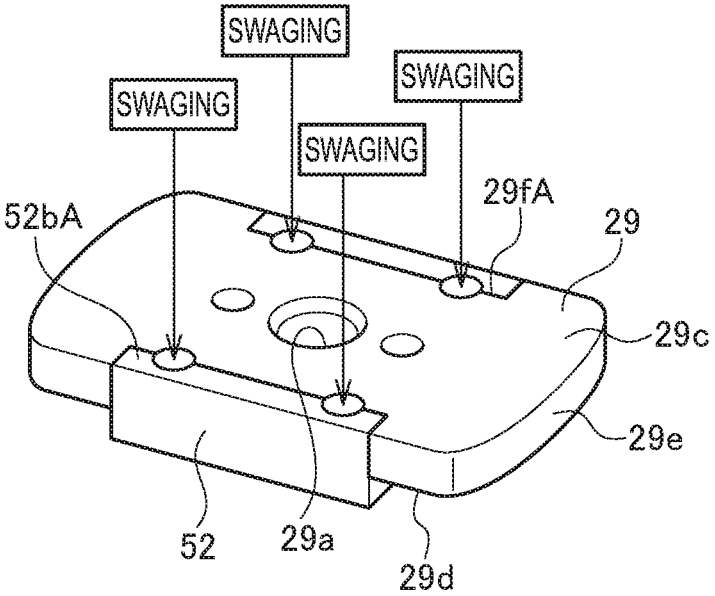
FIG. 14 schematically shows a sixth modification of the method of fixing the movable contactor and the lower yoke.
Figure 14:
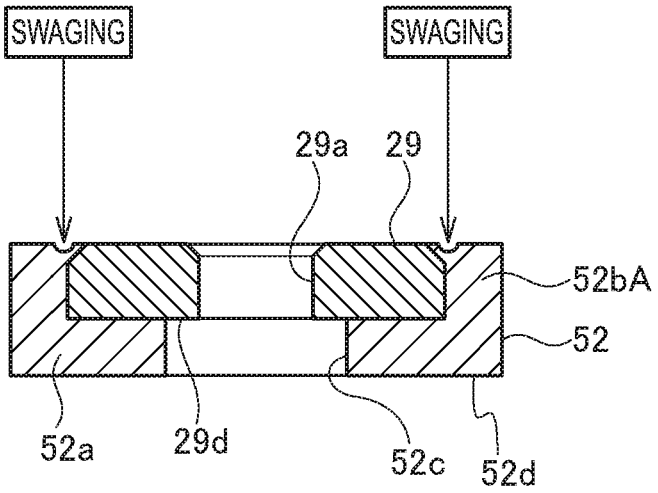

In FIG. 14, the lower yoke (first yoke) 52 and the movable contactor 29 are fixed to each other using swaging means as the fixing means.

To put it concretely, the lower yoke (first yoke) 52 and the movable contactor 29 are swaging-fixed (attached firmly) to each other by swaging side wall portions (swaging projections, or upward-bent portions) 52*b*A formed on the lower yoke (first yoke) 52 with the side wall portions (swaging projections, or upward-bent portions) 52*b*A inserted (in the embodiment, press-fitted) in cutouts (swaged portions) 29*f*A formed in the movable contactor 29. This configuration makes it possible to perform the fixing by swaging with the lower yoke (first yoke) 52 and the movable contactor 29 aligned to each other using the side wall portions (swaging projections, or upward-bent portions) 52*b*A, and thereby to facilitate the fixing work. Incidentally, although FIG. 14 shows an example of the swaging which is performed at two places on each side, the places where the swaging should be performed are not limited to those shown in FIG. 14.

Furthermore, in FIG. 14, too, the swaging may be performed with the side wall portions (swaging projections, or upward-bent portions) 52*b*A only inserted in the cutouts (swaged portions) 29*f*A instead of press-fitting the side wall portions (swaging projections, or upward-bent portions) 52*b*A in the cutouts (swaged portions) 29*f*A. In addition, insertion holes (swaged portions) in which to insert the side wall portions 52*b*A may be formed in the movable contactor 29. Moreover, swaging projections such as upward-bent portions may be formed on the movable contactor 29. Otherwise, swaging projections such as upward-bent portions may be formed on both the lower yoke (first yoke) 52 and the movable contactor 29, and swaged portions such as insertion holes may be formed in positions on the lower yoke (first yoke) 52 and the movable contactor 29 which correspond to the swaging projections such as upward-bent portions.

Figure 15:
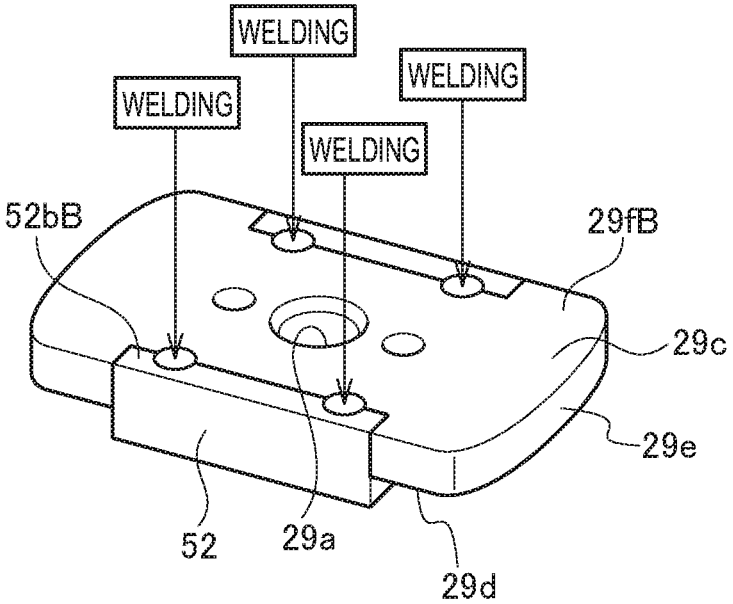
FIG. 15 schematically shows a seventh modification of the method of fixing the movable contactor and the lower yoke.
Figure 15:
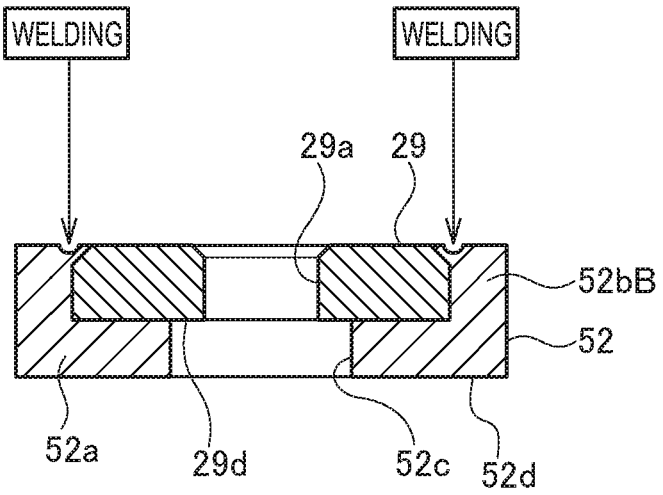

In FIG. 15, the lower yoke (first yoke) 52 and the movable contactor 29 are fixed to each other using welding means as the fixing means.

To put it concretely, the lower yoke (first yoke) 52 and the movable contactor 29 are weld-fixed (attached firmly) to each other by welding side wall portions 52*b*B formed on the lower yoke (first yoke) 52 to the movable contactor 29 with the side wall portions 52*b*B inserted (in the embodiment, press-fitted) in cutouts 29*f*B formed in the movable contactor 29. Since the lower yoke (first yoke) 52 is thus welded to the movable contactor 29, it is possible to achieve an increase in freedom of shape of the lower yoke (first yoke) 52 and the movable contactor 29. Incidentally, although FIG. 15 shows an example of the welding which is performed at two places on each side, the places where the welding should be performed are not limited to those shown in FIG. 15. Furthermore, the welding may be performed with the side wall portions 52*b*B only inserted in the cutouts 29*f*B instead of press-fitting the side wall portions 52*b*B in the cutouts 29*f*B.

Figure 16A:
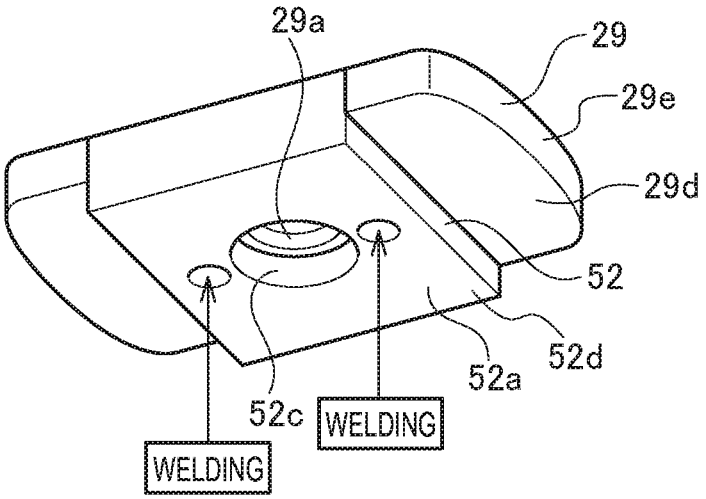
FIG. 16 schematically shows an eighth modification of the method of fixing the movable contactor and the lower yoke.
Figure 16B:
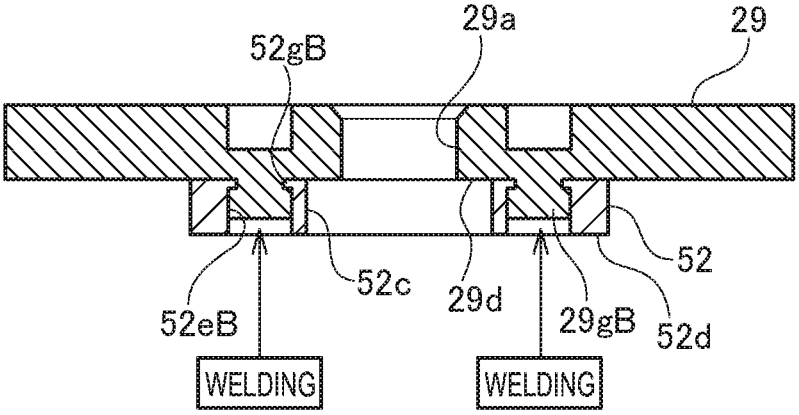

In FIG. 16, the lower yoke (first yoke) 52 and the movable contactor 29 are fixed to each other using welding means as the fixing means.

To put it concretely, the lower yoke (first yoke) 52 and the movable contactor 29 are weld-fixed (attached firmly) to each other by welding projections 29*g*B formed on the lower surface 29*d* of the movable contactor 29 to the lower yoke (first yoke) 52 with the projections 29*g*B inserted (in the embodiment, press-fitted) in insertion holes 52*e*B formed in the bottom wall portion 52*a* of the lower yoke (first yoke) 52. Since the lower yoke (first yoke) 52 is thus welded to the movable contactor 29, it is possible to achieve an increase in freedom of shape of the lower yoke (first yoke) 52 and the movable contactor 29.

Furthermore, the projections 29*g*B on the movable contactor 29 shown in FIG. 16 are formed by dowel formation processing as well. In addition, as shown in FIG. 16, the insertion holes 52*e*B respectively include steps 52*g*B formed thereon such that after being welded, the resultantly deformed projections 29*g*B are brought into engagement with the steps 52*g*B. Thereby, their retaining strength after the welding can be increased, and the separation between the lower yoke (first yoke) 52 and the movable contactor 29 can be more securely inhibited.

It should be noted that although FIG. 16 shows an example of the movable contactor 29 on which two projections 29*g*B are formed, the number of projections 29*g*B may be one, three, or more.

Moreover, instead of the steps 52*g*B, tapered portions may be formed in the insertion holes 52*e*B. Otherwise, in addition to the steps 52*g*B, tapered portions may be formed in the insertion holes 52*e*B. Moreover, neither the steps 52*g*B nor the tapered portions may be formed in the insertion holes 52*e*B. In addition, the welding may be performed with the projections 29*g*B only inserted in the insertion holes 52*e*B instead of press-fitting the projections 29*g*B in the insertion holes 52*e*B.

Figure 17A:
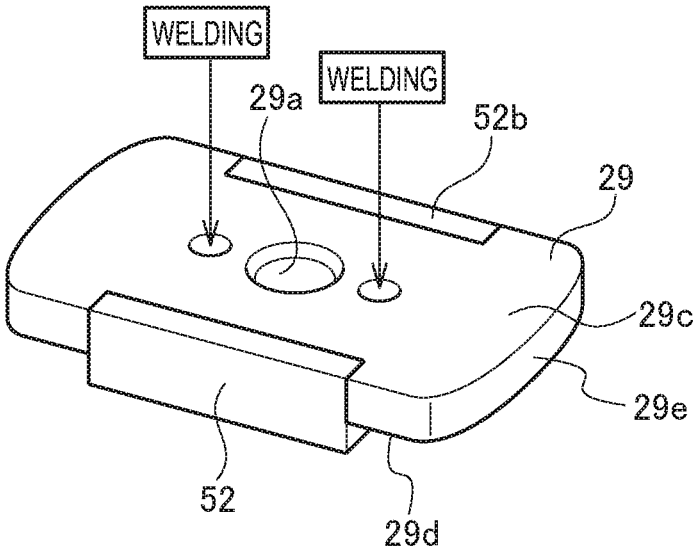
FIG. 17 schematically shows a ninth modification of the method of fixing the movable contactor and the lower yoke.
Figure 17B:
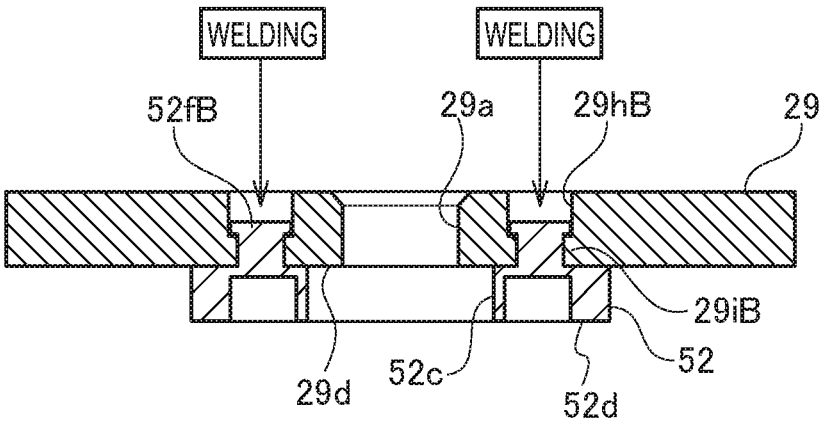

In FIG. 17, the lower yoke (first yoke) 52 and the movable contactor 29 are fixed to each other using welding means as the fixing means.

To put it concretely, the lower yoke (first yoke) 52 and the movable contactor 29 are weld-fixed (attached firmly) to each other by welding projections 52*f*B formed on the bottom wall portion 52*a* of the lower yoke (first yoke) 52 to the movable contactor 29 with the projections 52*f*B inserted (in the embodiment, press-fitted) in insertion holes 29*h*B formed in the movable contactor 29. Since the lower yoke (first yoke) 52 is thus welded to the movable contactor 29, it is possible to achieve an increase in freedom of shape of the lower yoke (first yoke) 52 and the movable contactor 29.

In addition, the projections 52*f*B on the lower yoke (first yoke) 52 shown in FIG. 17 are formed by dowel formation processing as well. Furthermore, as shown in FIG. 17, the insertion holes 29*h*B respectively include steps 29*i*B formed therein such that after welded, the resultantly deformed projections 52*f*B are brought into engagement with the steps 29*i*B. Thereby, their retaining strength after the welding can be increased, and the separation between the lower yoke (first yoke) 52 and the movable contactor 29 can be more securely inhibited.

It should be noted that although FIG. 17 shows an example of the lower yoke (first yoke) 52 on which two projections 52*f*B are formed, the number of projections 52*f*B may be one, three, or more.

Moreover, instead of the steps 29*i*B, tapered portions may be formed in the insertion hole 29*h*B. Otherwise, in addition to the steps 29*i*B, tapered portions may be formed in the insertion holes 29*h*B. Besides, neither the steps 29*i*B nor the tapered portions may be formed in the insertion holes 29*h*B. In addition, the welding may be performed with the projections 52*f*B only inserted in the insertion holes 29*h*B instead of press-fitting the projections 52*f*B in the insertion holes 29*h*B.

Furthermore, FIGS. 16 and 17 show examples where the projections are formed on either the lower yoke (first yoke) 52 or the movable contactor 29. Instead, however, the projections may be formed on both the lower yoke (first yoke) 52 and the movable contactor 29.

Figure 18A:
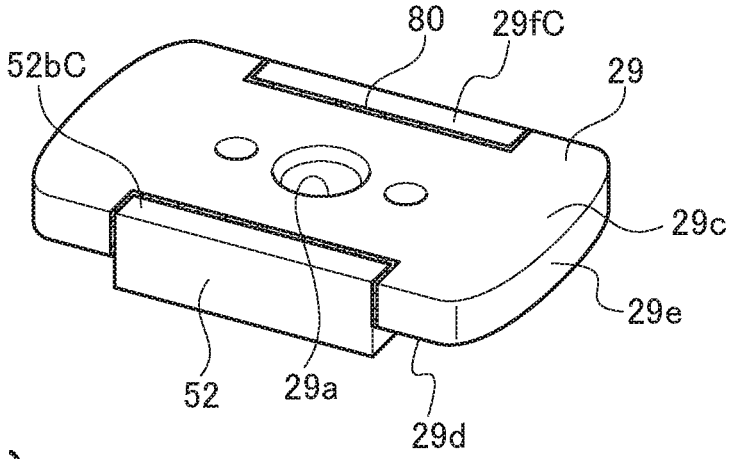
FIG. 18 schematically shows a 10th modification of the method of fixing the movable contactor and the lower yoke.
Figure 18B:
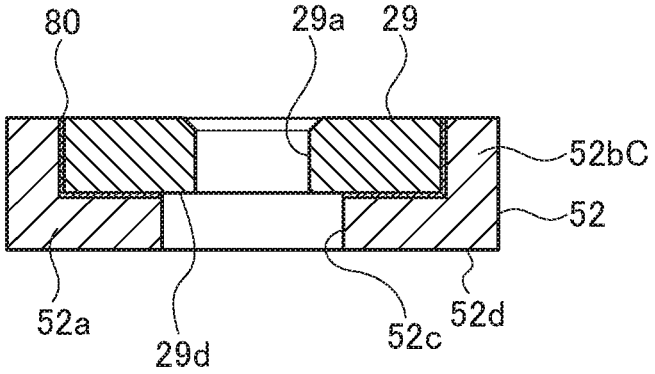

In FIG. 18, the lower yoke (first yoke) 52 and the movable contactor 29 are fixed to each other using welding means as the fixing means.

To put it concretely, the lower yoke (first yoke) 52 and the movable contactor 29 are adhesively fixed (attached firmly) to each other by bonding side wall portions 52*b*C of the lower yoke (first yoke) 52 to cutout portions 29*f*C in which to insert the side wall portions 52*b*C with adhesive 80 applied between the side wall portions 52*b*C and the cut portions 29*f*C. Since the lower yoke (first yoke) 52 is thus adhesively fixed to the movable contactor 29, it is possible to achieve an increase in freedom of shape of the lower yoke (first yoke) 52 and the movable contactor 29. Incidentally, although FIG. 18 shows an example where the adhesive 80 is applied to all of the mutually-facing surfaces of the side wall portions 52*b*C and the cutout portions 29*f*C, the adhesive 80 may be instead applied to part of their mutually-facing surfaces. Otherwise, the adhesive fixing may be performed by: forming projections on at least one of the lower yoke (first yoke) 52 and the movable contactor 29 by dowel formation processing or the like; and after application of the adhesive 80 to the projections, inserting the resultant projections into insertion holes, insertion recesses or the like which are formed in the other of the lower yoke (first yoke) 52 and the movable contactor 29.

Figure 19:
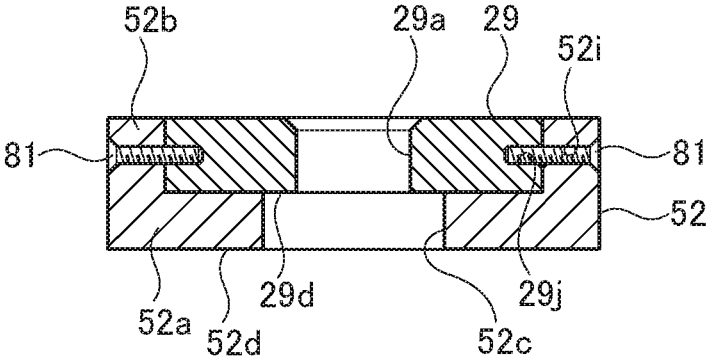
FIG. 19 is a cross-sectional view schematically showing an 11th modification of the method of fixing the movable contactor and the lower yoke.
Figure 20A:
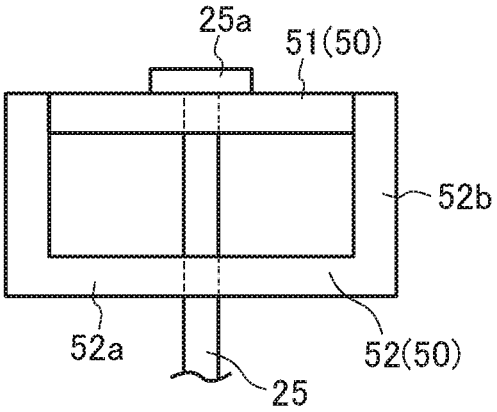
FIGS. 20(*a*)-20(*f*) include side views schematically showing modifications of an upper yoke and the lower yoke.
Figure 20B:
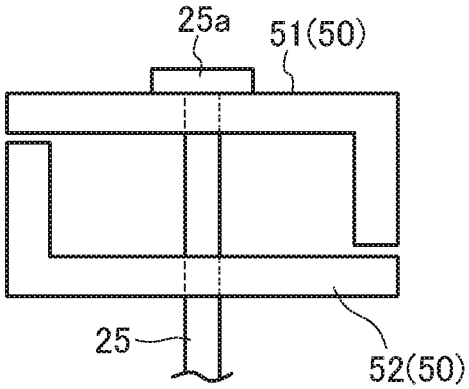
Figure 20C:
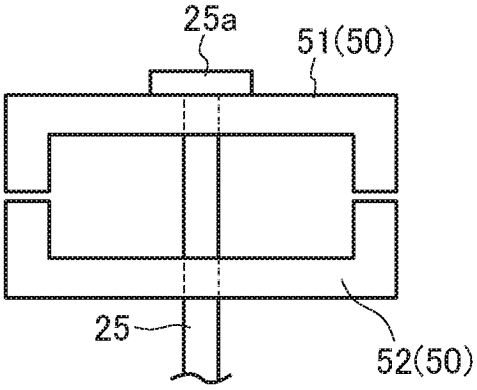
Figure 20D:
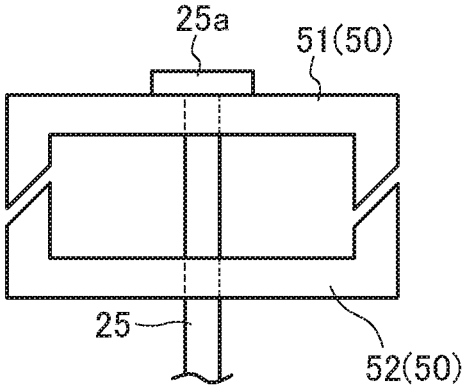
Figure 20E:
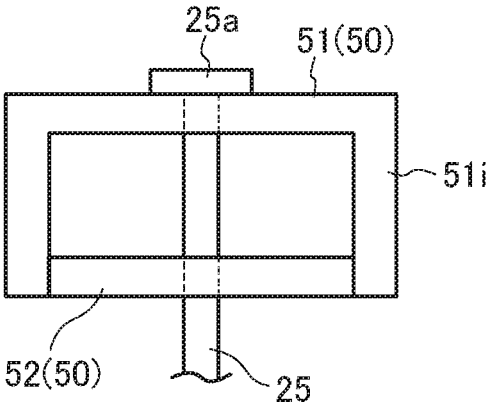
Figure 20F:
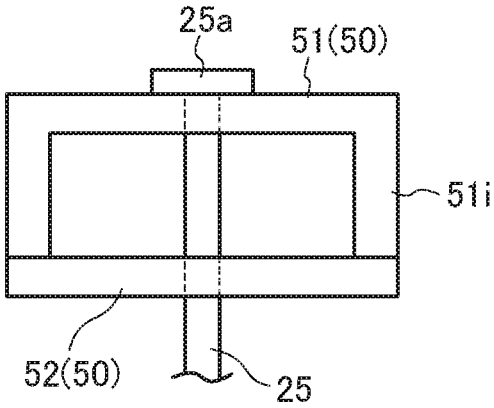

In FIG. 19, the lower yoke (first yoke) 52 and the movable contactor 29 are fixed to each other using joint means as the fixing means.

To put it concretely, the side wall portions 52*b* of the lower yoke (first yoke) 52 include insertion portions 52*i* formed to extend in the horizontal direction, while side surfaces of the portions of the movable contactor 29 in which the respective cuts 29*f* are formed include insertion portions 29*j* formed to extend in the horizontal direction, and to communicate with the insertion portions 52*i* when the side wall portions 52*b* are inserted (press-fitted) in the cutouts 29*f*. Thereby, the lower yoke (first yoke) 52 and the movable contactor 29 are fixed (joint-fixed) to each other by inserting screws 81 as joint members in the insertion portions 52*i* and the insertion portions 29*j* with the insertion portions 52*i* and the insertion portions 29*j* communicating with each other. Since the lower yoke (first yoke) 52 and the movable contactor 29 are thus joint-fixed to each other, it is possible to achieve an increase in freedom of shape of the lower yoke (first yoke) 52 and the movable contactor 29.

It should be noted that the joint members are not limited to the screws 81. For example, bar-shaped members each with no threaded groove may be used such that ends of the bar-shaped members are press-fitted in the insertion portions 52*i* while the other ends thereof are press-fitted in the insertion portions 29*j*.

Furthermore, although the foregoing embodiment and FIGS. 9 to 19 show the examples where the side wall portions are inserted (press-fitted) in the respective cutouts, the movable contactor 29 may be provided with no cutouts so that the side surfaces of the movable contactor 29 can be held between and by the two side wall portions.

Moreover, although FIGS. 14, 15 and 18 show the examples where the projections are formed on either the lower yoke (first yoke) 52 or the movable contactor 29, no projections may be formed on either the lower yoke (first yoke) 52 or the movable contactor 29.

Besides, the foregoing embodiment shows the example where: the upper yoke 51 is shaped almost like a rectangular plate; and the lower yoke 52 is formed from the bottom wall portion 52*a*, and the side wall portions 52*b* formed rising from the two ends of the bottom wall portion 52*a*, such that the bottom wall portion 52*a* and the side wall portions 52*b* make the lower yoke 52 shaped almost like the letter U. Instead, however, the upper yoke 51 and the lower yoke 52 may take on shapes shown in FIG. 20.

To put it concretely, as shown in FIG. 20(*a*), the upper yoke 51 shaped almost like a rectangular plate and the lower yoke 52 shaped almost like the letter U may surround the movable contactor 29 by disposing the upper yoke 51 between the side wall portions 52*b*, 52*b* of the lower yoke 52.

Otherwise, as shown in FIG. 20(*b*), the upper yoke 51 shaped like the letter L and the lower yoke 52 shaped like the letter L may surround the movable contactor 29.

Instead, as shown in FIG. 20(*c*), the upper yoke 51 shaped like the letter U and the lower yoke 52 shaped like the letter U may surround the movable contactor 29. In this case, as shown in FIG. 20(*d*), their mutually-facing surfaces may be formed obliquely.

Otherwise, as shown in FIG. 20(*e*), the upper yoke 51 shaped like the letter U and the lower yoke 52 shaped almost like a rectangular plate may surround the movable contactor 29. In this case, instead of disposing the lower yoke 52 shaped almost like a rectangular plate between side wall portions 51*i* of the upper yoke 51 shaped like the letter U, the lower yoke 52 shaped almost like a rectangular plate may be butted to the side wall portions 51*i* of the upper yoke 51 shaped like the letter U, as shown in FIG. 20(*f*).

Such shapes can bring about the same operation/working effect as the foregoing embodiment.

It should be noted that, in this case, the lower yoke (first yoke) 52 and the movable contactor 29 can be fixed to each other using the forgoing methods.

Figure 21:
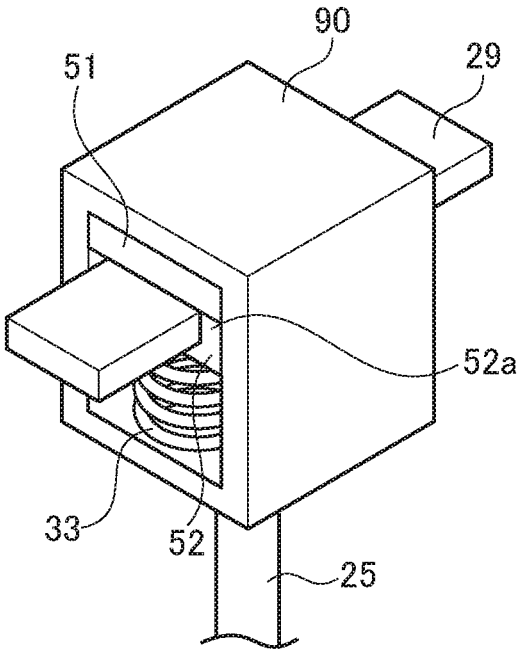
FIG. 21, which includes FIGS. 21(*a*) and 21(*b*), schematically show an example where the movable contactor is retained by a holder.
Figure 21:
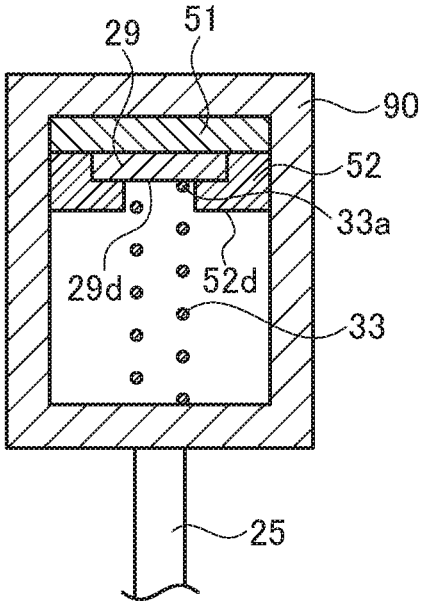

Meanwhile, as shown in FIG. 21, a structure may be used in which the movable contactor 29 is retained by a holder 90.

FIG. 21 shows an example of the holder 90 which, in a side view, is shaped almost like a rectangle, and to which the shaft 25 is fixed. FIGS. 21(*a*) and 21(*b*) show the example of the holder 90 in which the movable contactor 29 as surrounded by the upper yoke 51 and the lower yoke 52, and the contact pressure spring 33 as compressed are inserted.

Such shapes can bring about the same operation/working effect as the foregoing embodiment.

In addition, because of the structure in which the movable contactor 29 as surrounded by the upper yoke 51 and the lower yoke 52 is retained by the holder 90, it is possible to more securely inhibit the positional displacement of the lower yoke (first yoke) 52 relative to the movable contactor 29, and to more securely restrict the movable contactor 29 from going away from the fixed contacts 35*a*.

Figure 22A:
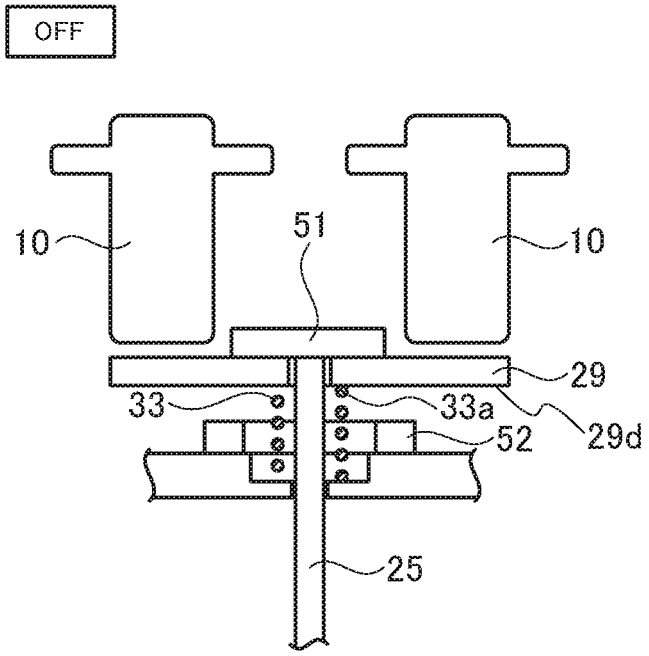
FIG. 22, which includes FIGS. 22(*a*) and 22(*b*), schematically show a modification of the lower yoke.
Figure 22B:
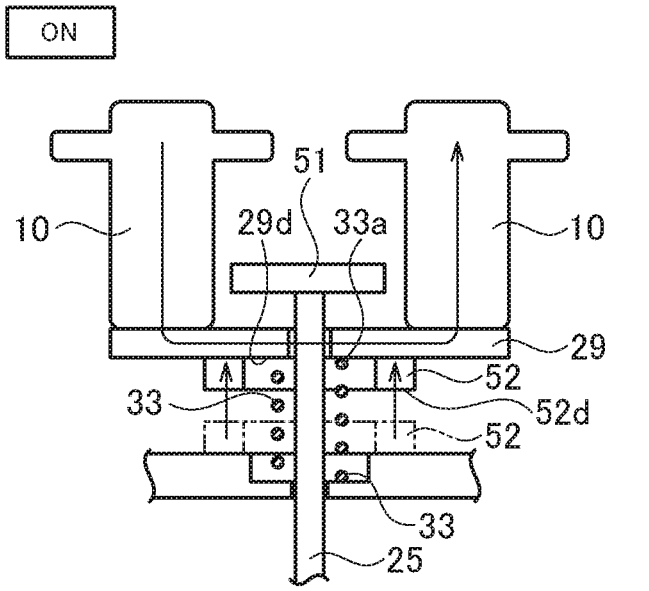

Meanwhile, as shown in FIG. 22, the lower yoke 52 may be disposed at least on the lower side of the movable contactor 29 (on the opposite side in the driving shaft direction) only while the movable contacts 29*b* are in contact with the fixed contacts 35*a*, that is to say, only while the power supply is on.

In other words, a configuration may be used in which: the lower yoke 52 are not fixed to the movable contactor 29; while the power supply is off, the lower yoke 52 is disposed under and away from the movable contactor 29; and while the power supply is on, produced magnetic force may attract the lower yoke 52 to the movable contactor 29. In this case, if the lower yoke 52 has an insertion hole 53*c* and is shaped like a ring so that the shaft 25 and the contact pressure spring 33 can be inserted through the insertion hole 53*c*, the shaft 25 and the contact pressure spring 33 function as guides so that the lower yoke 52 can be more smoothly moved relative to the movable contactor 29 in the vertical direction (the driving shaft direction).

Figure 23A:
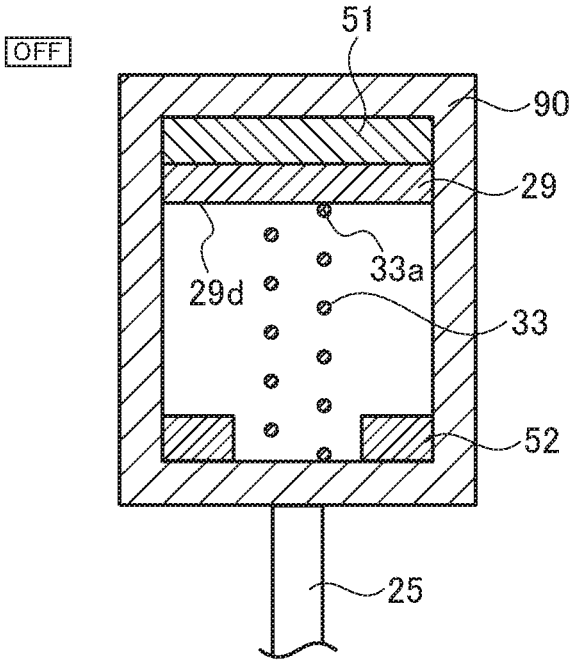
FIG. 23, which includes FIGS. 23(*a*) and 23(*b*), schematically show an example where the movable contactor is retained by the holder using the lower yoke shown in FIGS. 22(*a*) and 22(*b*).
Figure 23B:
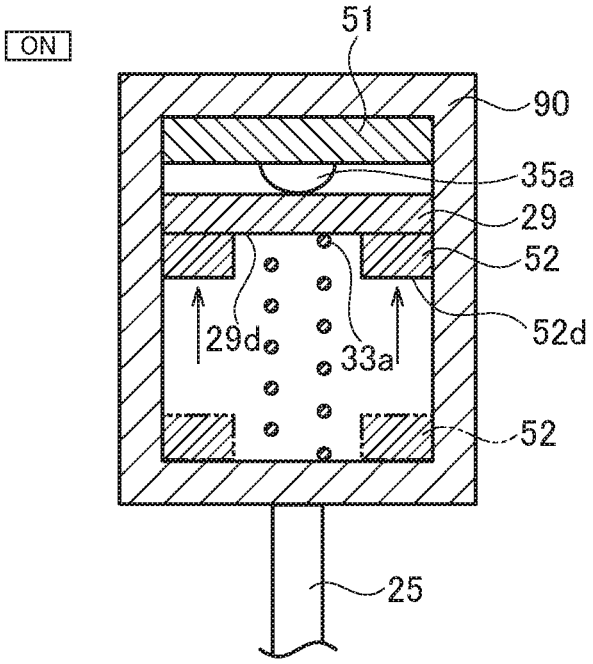

Otherwise, as shown in FIG. 23, a structure in which the movable contactor 29 is retained by the holder 90 may be used such that only while the power supply is on, the lower yoke 52 is disposed at least on the lower side of the movable contactor 29 (on the opposite side in the driving shaft direction).

This makes it possible to make the holder 90 function as a guide, and to move the lower yoke 52 relative to the movable contactor 29 in the vertical direction (the driving shaft direction) more securely and smoothly.

Figure 24:
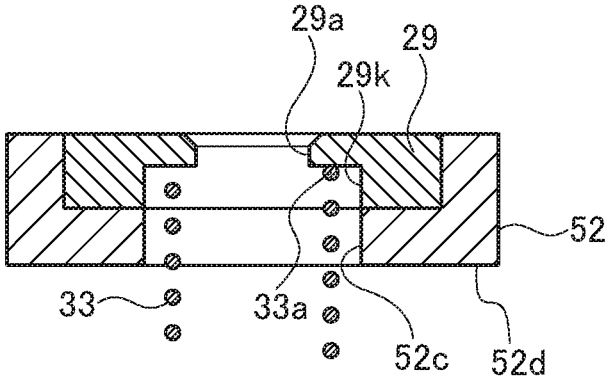
FIG. 24 is a cross-sectional view schematically showing a modification of the movable contactor.

Meanwhile, as shown in FIG. 24, a lower portion of the movable contactor 29 may include an insertion hole 29*k* formed therein to communicate with the insertion hole 29*a* and to be larger in diameter than the insertion hole 29*a* such that the biasing end is located higher than the lower surface of the lower yoke 52. This makes it possible to make the height of the contact device 1 much smaller.

Figure 25:
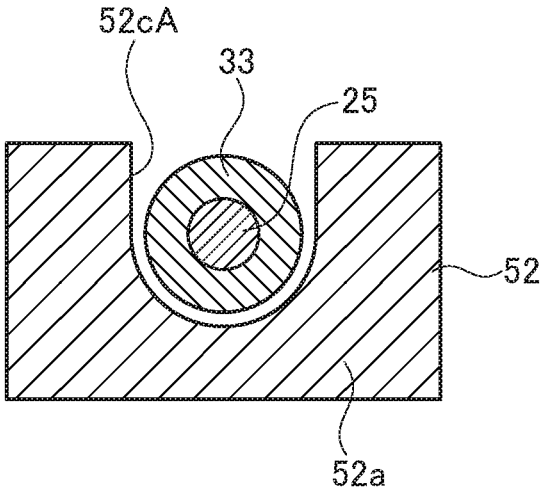
FIG. 25 is a plan cross-sectional view schematically showing another modification of the lower yoke.

Instead, as shown in FIG. 25, the lower yoke 52 may include a cutout portion 52*c*A formed therein to be opened in a side portion, so that the biasing end can be located higher than the lower surface of the lower yoke 52. In other words, the lower yoke 52 may include the cutout portion (hole portion) 52*c*A formed to penetrate the lower yoke 52 in the driving shaft direction, and to be opened in the side portion, such that the upper end (biasing end) 33*a* of the contact pressure spring (biasing portion) 33 is housed inside the cutout portion (hole portion) 52*c*A.

This configuration can bring about the same operation/working effect as the foregoing embodiment.

Furthermore, the foregoing embodiment shows an example where the fixed terminals 35, 35 are provided on the opposite side of the driving block 2 (inclusive of the coil and the like) from the movable contactor 29. Instead, however, a structure may be used in which, as shown in FIGS. 26 and 27, the fixed terminals 35, 35 are provided on the same side, relative to the movable contactor 29, as is the driving block 2.

Figure 26:
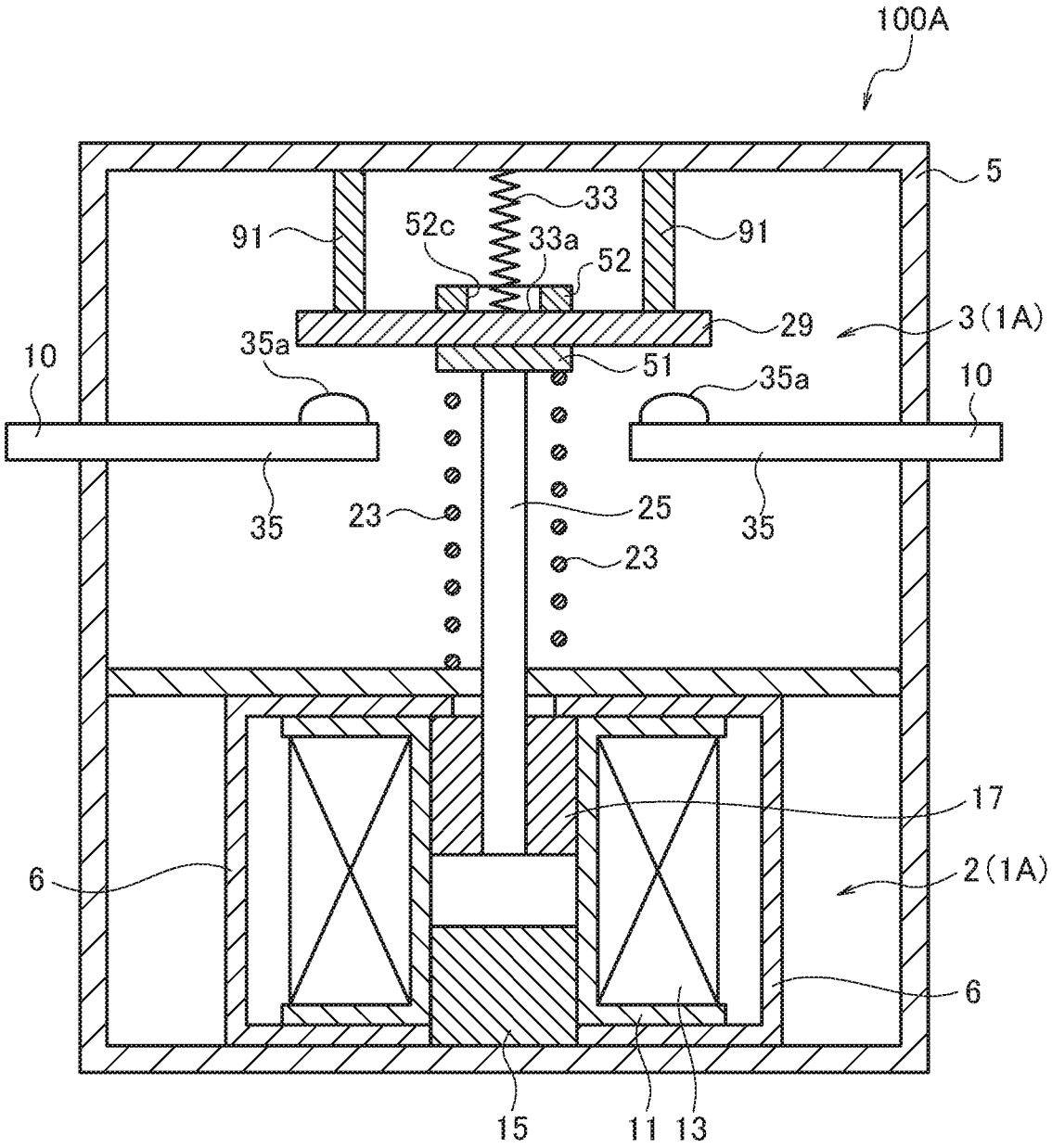
FIG. 26 is a cross-sectional view schematically showing a modification of the electromagnetic relay with a power supply being off.
Figure 27:
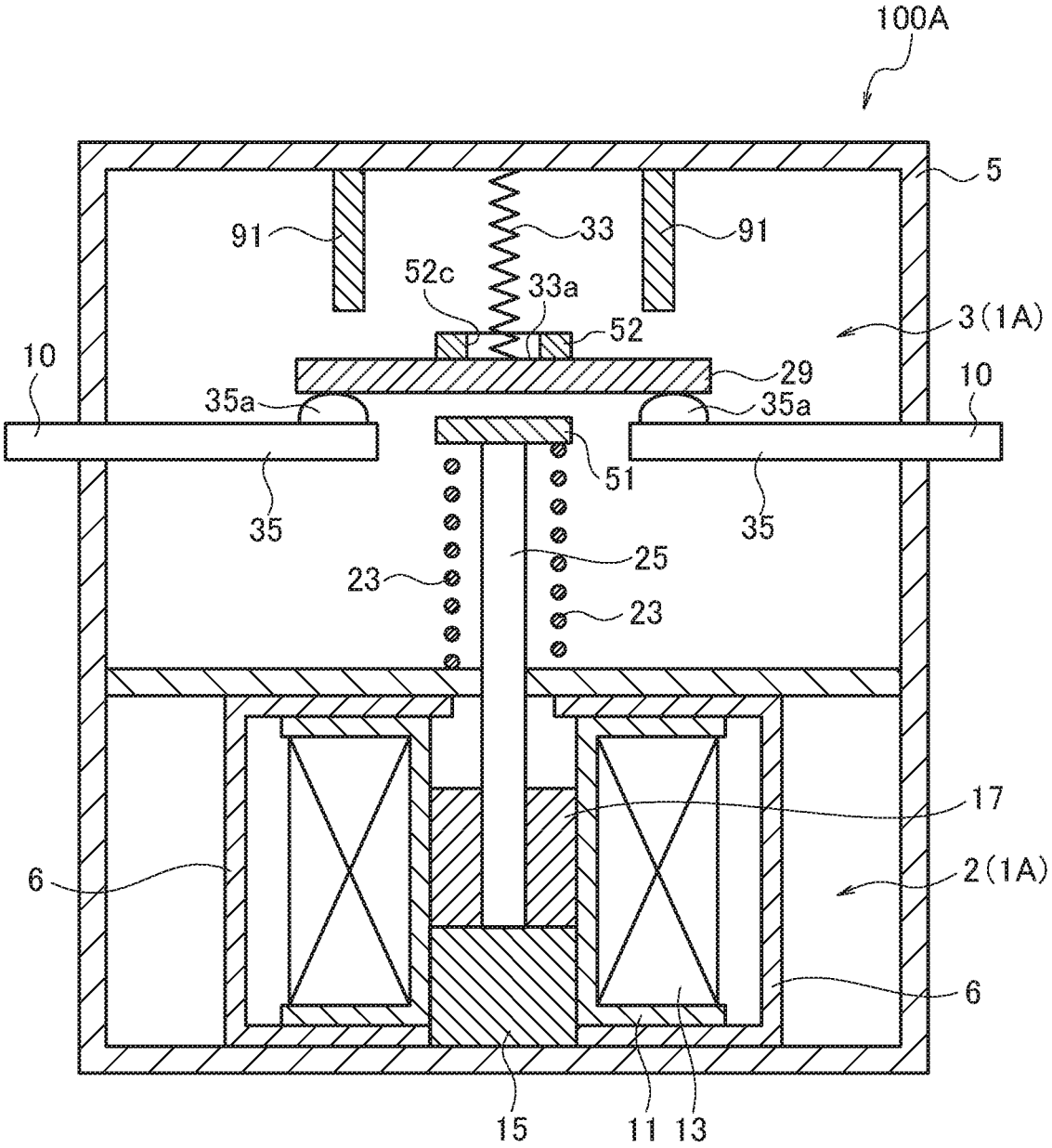

FIGS. 26 and 27 show an example of an electromagnetic relay 100A mounting a contact device 1A which is formed by integrally combining: the driving block 2 to be located in the lower portion of the contact device 1A and the contact block 3 to be located in the upper portion of the contact device 1A.

The contact device 1A is housed inside the case 5 shaped like a hollow box. The pair of main terminals 10 which respectively have the fixed terminals 35 provided with the fixed contacts 35*a* are attached to the case 5.

In addition, the driving block 2 includes: the coil bobbin 11 shaped like a hollow cylinder with the coil 13 wound around the coil bobbin 11; and the yoke 6 made from magnetic material and surrounding the coil bobbin 11.

The driving block 2 further includes: the fixed iron core 15 fixed to the cylindrical inner portion of the coil bobbin 11 and magnetized by the coil 13 when the coil 13 is electrified; and the movable iron core 17 facing the fixed iron core 15 in the vertical direction (the axial direction) and disposed inside the cylinder of the coil bobbin 11. The range of movement of the movable iron core 17 is set between the initial position (see FIG. 26) away upward from the fixed iron core 15 and the contact position (see FIG. 27) where the movable iron core 17 is in contact with the fixed iron core 15. Furthermore, the return spring 23 formed from a coil spring biases the movable iron core 17 upward (in a direction in which the movable iron core 17 is returned to the initial position). In other words, the return spring 23 biases the movable iron core 17 in the direction in which the movable iron core 17 goes farther from the fixed iron core 15 (upward in FIG. 26).

Meanwhile, the contact block 3 includes: the pair of fixed terminals 35; and the movable contactor 29 disposed to span the pair of fixed contacts 35*a*. In addition, parts of the lower surface of the movable contactor 29 which face the fixed contacts 35*a* are respectively provided with the movable contacts.

The contact block 3 further includes a yoke to be disposed at least on the upper side of the movable contactor 29 (on the opposite side in the driving shaft direction) while the movable contacts 29*b* are in contact with the fixed contacts 35*a* (in the embodiment, while the power supply is on).

To put it concretely, the yoke is formed from: the upper yoke (first yoke) 52 disposed on the upper side of the movable contactor 29; and the lower yoke (second yoke) 51 disposed on the lower side of the movable contactor 29.

Furthermore, the shaft 25 is provided integrally with the lower yoke (second yoke) 51.

Moreover, the contact pressure spring (biasing portion) 33 formed from a coil spring biases the movable contactor 29 downward (toward the one side in the driving shaft direction).

In this respect, in the contact device 1A shown in FIGS. 26 and 27, upward biasing force applied to the movable contactor 29 by the return spring 23 is greater than downward biasing force applied to the movable contactor 29 by the contact pressure spring 33. For this reason, while the movable iron core 17 is in the initial position, the upward movement of the movable contactor 29 is restricted by a stopper 91 provided to the case 5.

Meanwhile, while the movable iron core 17 is in the contact position, the lower yoke (second yoke) 51 is brought away from the movable contactor 29 so that the return spring 23 does not bias the movable contactor 29 upward. This enables the downward biasing force of the contact pressure spring 38 to work more efficiently on the movable contactor 29.

This configuration can also bring about the same operation/working effect as the foregoing embodiment.

It should be noted that it is possible not to provide a stopper 91 if the biasing forces of the return spring 23 and the contact pressure spring 33 are adjusted appropriately. To put it concretely, the adjustment may be performed such that: while the movable iron core 17 is in the initial position, the movable contacts are put away from the fixed contacts 35*a*; and a balance is maintained between the biasing force applied to the movable contactor 29 by the return spring 23 and the biasing force applied to the movable contactor 29 by the contact pressure spring 33 with the distance between the fixed contacts 35*a* and the movable contacts being equal to or less than the distance of the movement of the movable iron core 17. This makes it possible to inhibit the upward and downward movement of the movable contactor 29 even if no stopper 91 is provided.

In addition, the foregoing embodiment shows an example of the contact device 1 in which the upper surface 15*e* of the projection 15*d* serves as the spring receiving portion for the contact pressure spring 33. Instead, however, a contact device 1B may be formed in which, as shown in FIG. 28, a spring receiving portion 49*b* for the contact pressure spring 33 is formed in the peripheral edge portion of the insertion hole 49*a* of the holding plate 49.

Figure 28:
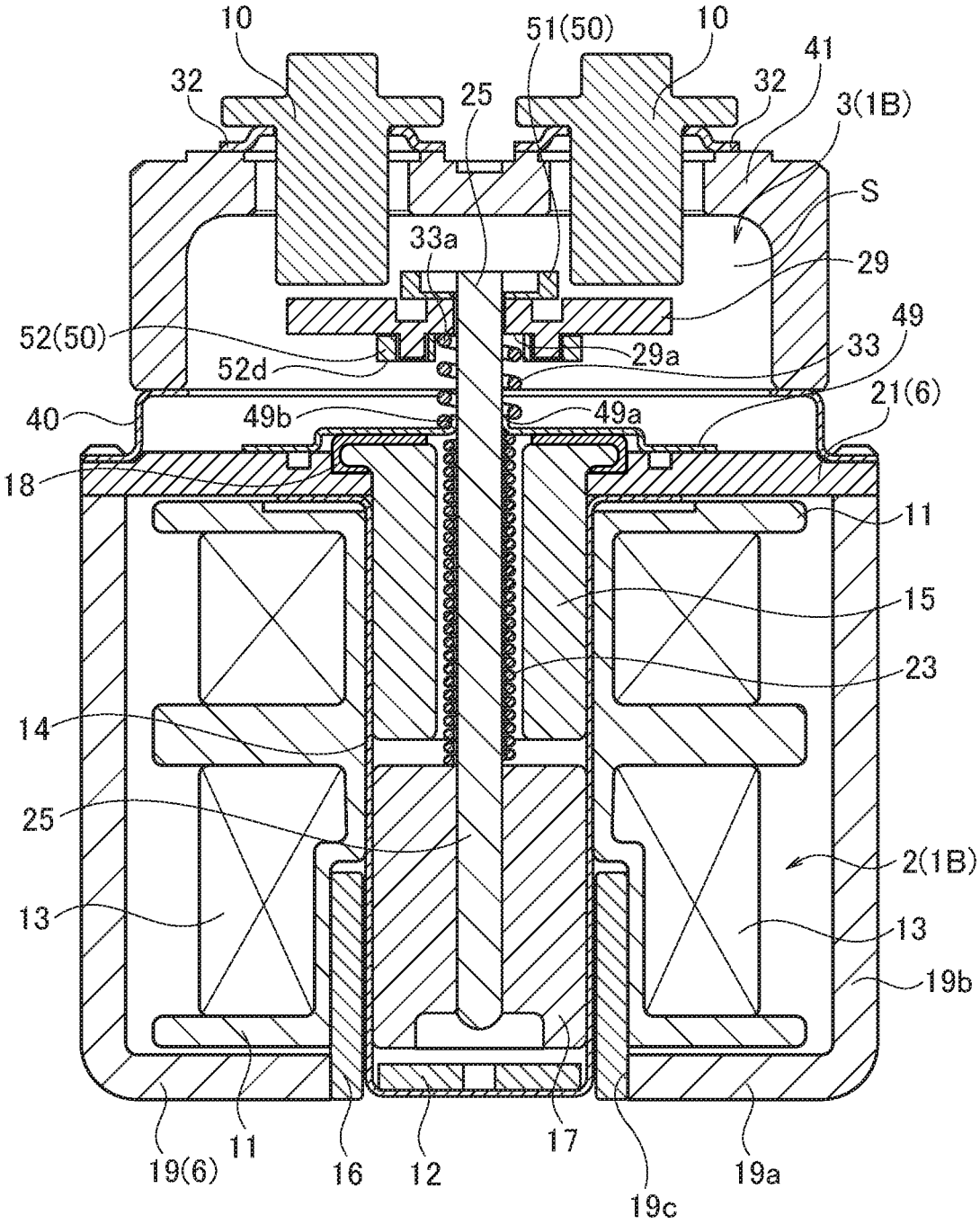
FIG. 28 is a side cross-sectional view schematically showing a modification of the contact device, and corresponding to FIG. 4(*a*).
Figure 39:
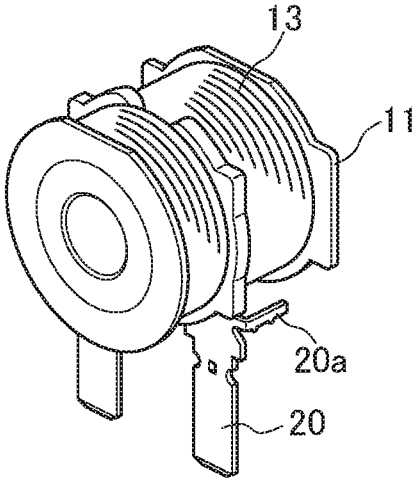
FIG. 39 schematically shows a coil portion of the contact device shown in FIG. 27.
Figure 39:
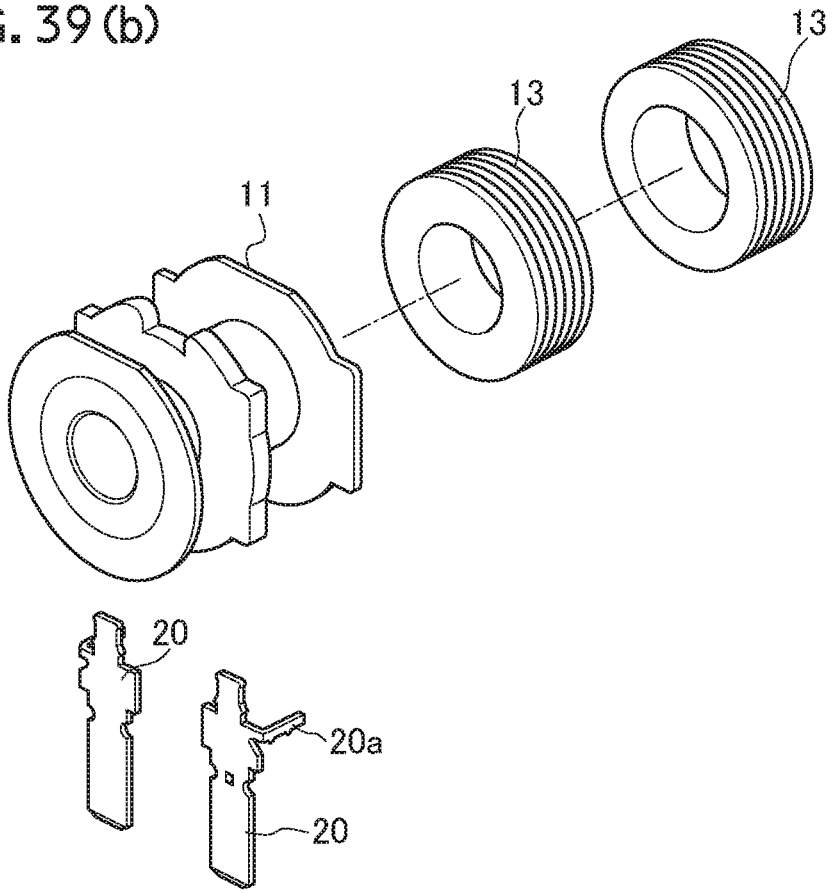

It should be noted that, in the contact device 1B, as shown in FIGS. 28 and 39, the coil 13 is wound around each of multiple (two) coil bobbins 11. Instead, however, the coil 13 may be wound around the single coil bobbin 11, as shown in FIGS. 1 to 4.

Furthermore, FIG. 28 shows an example where the movable contactor 29 and the lower yoke 52 are fixed to each other using the method shown in FIG. 9. Instead, however, the movable contactor 29 and the lower yoke 52 may be fixed to each other using other methods. Otherwise, the movable contactor 29 and the lower yoke 52 do not have to be fixed to each other.

This configuration can also bring about the same operation/working effect as the foregoing embodiment.

Besides, the movable contactor 29 may be pressed by the contact pressure spring (biasing portion) 33 in manners shown in FIGS. 29 to 38.

Figure 29:
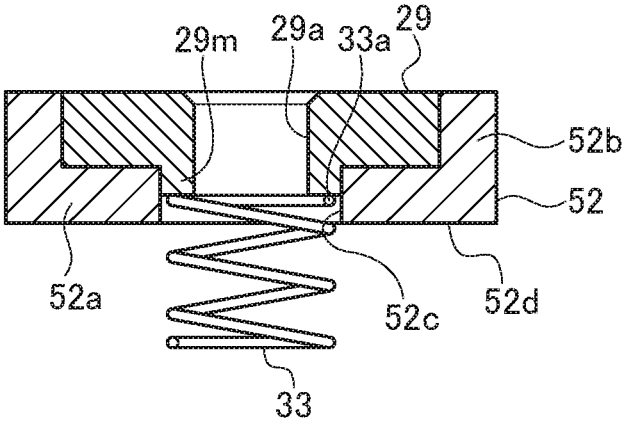
FIG. 29 is a cross-sectional view schematically showing a first modification of a condition in which the movable contactor is pressed by the contact pressure spring.

In FIG. 29, the movable contactor 29 includes a projection 29*m* formed to be inserted in the insertion hole 52*c* of the lower yoke 52. The lower surface of the projection 29*m* is formed to be located higher than the lower surface (the surface of the yoke 50 on the opposite side in the driving shaft direction) 52*d* of the lower yoke (first yoke) 52 (i.e., located on the one side in the driving shaft direction, or closer to the movable contactor 29).

Furthermore, the contact pressure spring (biasing portion) 33 includes the upper end (biasing end) 33*a* configured to make the upward biasing force act on the movable contactor 29 by directly pressing the movable contactor 29 which is a member other than the yoke 50.

Moreover, in FIG. 29, the upper end (biasing end) 33*a* of the contact pressure spring (biasing portion) 33 is configured to press the lower surface of the projection 29*m*.

In other words, the upper end (biasing end) 33*a* of the contact pressure spring (biasing portion) 33 is located higher than the lower surface (the surface of the yoke 50 on the opposite side in the driving shaft direction) 52*d* of the lower yoke (first yoke) 52 (i.e., located on the one side in the driving shaft direction, or closer to the movable contactor 29).

This configuration can also bring about almost the same operation/working effect as the foregoing embodiment.

Furthermore, the configuration shown in FIG. 29 increases the cross-sectional area of the movable contactor 29 by an amount corresponding to the provision of the projection 29*m*. For this reason, the configuration shown in FIG. 29 makes it possible to increase the area of the electrification, and to enhance the electrification performance more.

In other words, the configuration shown in FIG. 29 makes it possible to enhance the electrification performance more by reducing the size of the contact device in its height direction (the vertical direction, or the driving shaft direction).

Figure 30:
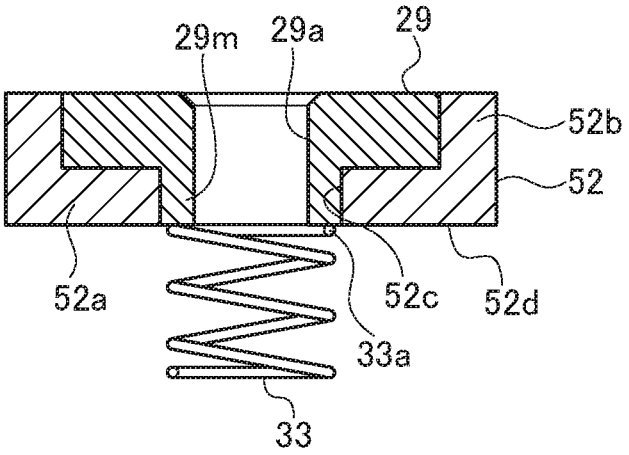
FIG. 30 is a cross-sectional view schematically showing a second modification of the condition in which the movable contactor is pressed by the contact pressure spring.

In FIG. 30, the movable contactor 29 includes the projection 29*m* formed to be inserted in the insertion hole 52*c* of the lower yoke 52. The lower surface of the projection 29*m* is formed flush with the lower surface (the surface of the yoke 50 on the opposite side in the driving shaft direction) 52*d* of the lower yoke (first yoke) 52.

Furthermore, the contact pressure spring (biasing portion) 33 includes the upper end (biasing end) 33*a* configured to make the upward biasing force act on the movable contactor 29 by directly pressing the movable contactor 29 which is a member other than the yoke 50. The upper end (biasing end) 33*a* of the contact pressure spring (biasing portion) 33 is configured to press the lower surface of the projection 29*m*.

In other words, the upper end (biasing end) 33*a* of the contact pressure spring (biasing portion) 33 is flush with the lower surface (the surface of the yoke 50 on the opposite side in the driving shaft direction) 52*d* of the lower yoke (first yoke) 52.

This configuration can also bring about the same operation/working effect as the foregoing embodiment.

Furthermore, the configuration shown in FIG. 30 increases the cross-sectional area of the movable contactor 29 by the amount corresponding to the provision of the projection 29*m*. For this reason, the configuration shown in FIG. 30 makes it possible to increase the area of the electrification, and to enhance the electrification performance more.

The configuration like this shown in FIG. 30 makes it possible to enhance the electrification performance much more while inhibiting an increase in size of the contact device in its height direction (the vertical direction, or the driving shaft direction) to an utmost extent.

Figure 31:
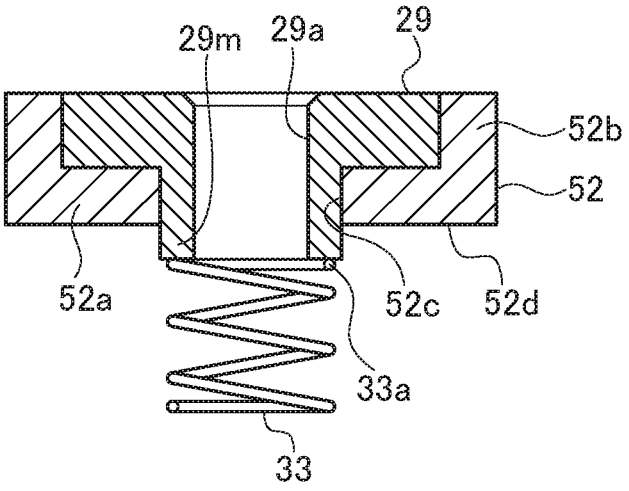
FIG. 31 is a cross-sectional view schematically showing a third modification of the condition in which the movable contactor is pressed by the contact pressure spring.

In FIG. 31, the movable contactor 29 includes the projection 29*m* formed to be inserted in the insertion hole 52*c* of the lower yoke 52. The lower surface of the projection 29*m* is formed to be located lower than the lower surface (the surface of the yoke 50 on the opposite side in the driving shaft direction) 52*d* of the lower yoke (first yoke) 52 (i.e., located on the opposite side in the driving shaft direction).

Furthermore, the contact pressure spring (biasing portion) 33 includes the upper end (biasing end) 33*a* configured to make the upward biasing force act on the movable contactor 29 by directly pressing the movable contactor 29 which is a member other than the yoke 50. The upper end (biasing end) 33*a* of the contact pressure spring (biasing portion) 33 is configured to press the lower surface of the projection 29*m*.

In other words, the upper end (biasing end) 33*a* of the contact pressure spring (biasing portion) 33 is located lower than the lower surface (the surface of the yoke 50 on the opposite side in the driving shaft direction) 52*d* of the lower yoke (first yoke) 52 (i.e., located on the opposite side in the driving shaft direction).

This configuration can bring about the same operation/working effect as the foregoing embodiment.

Furthermore, the configuration shown in FIG. 31 increases the cross-sectional area of the movable contactor 29 by the amount corresponding to the provision of the projection 29*m*. For this reason, the configuration shown in FIG. 30 makes it possible to increase the area of the electrification, and to enhance the electrification performance more. In this case, a desirable electrification performance can be obtained by appropriately adjusting the amount of projection of the projection 29*m* from the lower surface 52*d* of the lower yoke 52.

It should be noted that a part of the projection 29*m* which projects downward from the lower surface 52*d* of the lower yoke 52 may be provided with a flange portion or the like such that the flange portion or the like overlaps the lower surface 52*d* in a view in the driving shaft direction. In this case, the upper end (biasing end) 33*a* may be configured to indirectly press the yoke 50 upward by making the flange portion or the like press the lower surface 52*d*.

Figure 32:
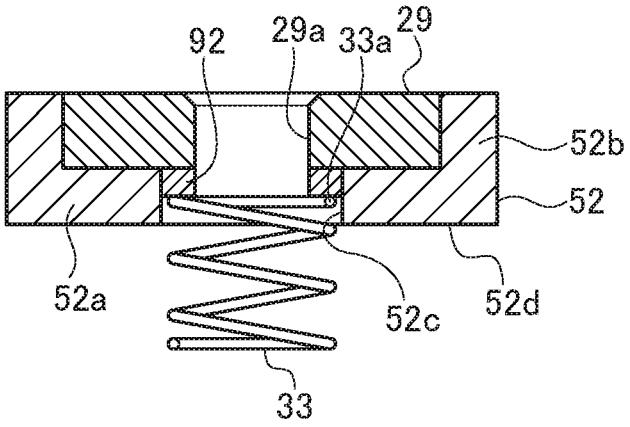
FIG. 32 is a cross-sectional view schematically showing a fourth modification of the condition in which the movable contactor is pressed by the contact pressure spring.

In FIG. 32, a spacer 92 formed from a member other than the yoke 50 and the movable contactor 29 is inserted in the insertion hole 52*c* of the lower yoke 52. The lower surface of the spacer 92 is formed to be located higher than the lower surface (the surface of the yoke 50 on the opposite side in the driving shaft direction) 52*d* of the lower yoke (first yoke) 52 (i.e., located on the one side in the driving shaft direction, or closer to the movable contactor 29).

Furthermore, the contact pressure spring (biasing portion) 33 includes the upper end (biasing end) 33*a* configured to make the upward biasing force act on the movable contactor 29 by pressing the spacer 92 which is a member other than the movable contactor 29. The upper end (biasing end) 33*a* of the contact pressure spring (biasing portion) 33 is configured to press the lower surface of the projection 29*m*.

In other words, the upper end (biasing end) 33*a* of the contact pressure spring (biasing portion) 33 is located higher than the lower surface (the surface of the yoke 50 on the opposite side in the driving shaft direction) 52*d* of the lower yoke (first yoke) 52 (i.e., located on the one side in the driving shaft direction, or closer to the movable contactor 29).

This configuration can also bring about almost the same operation/working effect as the foregoing embodiment.

Figure 33:
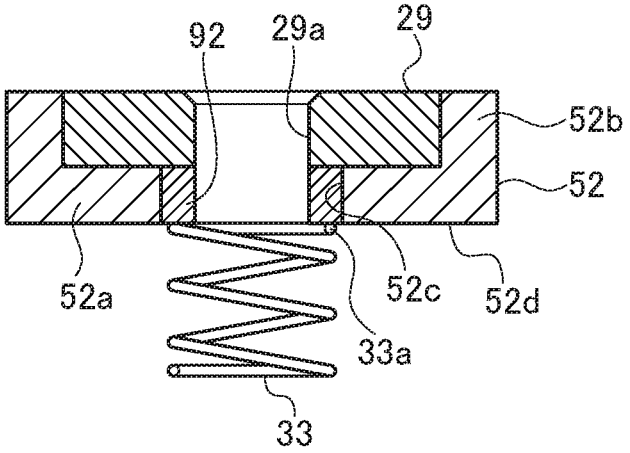
FIG. 33 is a cross-sectional view schematically showing a fifth modification of the condition in which the movable contactor is pressed by the contact pressure spring.

In FIG. 33, the spacer 92 formed from a member other than the yoke 50 and the movable contactor 29 is inserted in the insertion hole 52*c* of the lower yoke 52. The lower surface of the spacer 92 is formed flush with the lower surface (the surface of the yoke 50 on the opposite side in the driving shaft direction) 52*d* of the lower yoke (first yoke) 52.

Furthermore, the contact pressure spring (biasing portion) 33 includes the upper end (biasing end) 33*a* configured to make the upward biasing force act on the movable contactor 29 by pressing the spacer 92 which is a member other than the movable contactor 29. The upper end (biasing end) 33*a* of the contact pressure spring (biasing portion) 33 is configured to press the lower surface of the projection 29*m*.

In other words, the upper end (biasing end) 33*a* of the contact pressure spring (biasing portion) 33 is flush with the lower surface (the surface of the yoke 50 on the opposite side in the driving shaft direction) 52*d* of the lower yoke (first yoke) 52.

This configuration can also bring about the same operation/working effect as the foregoing embodiment.

Figure 34:
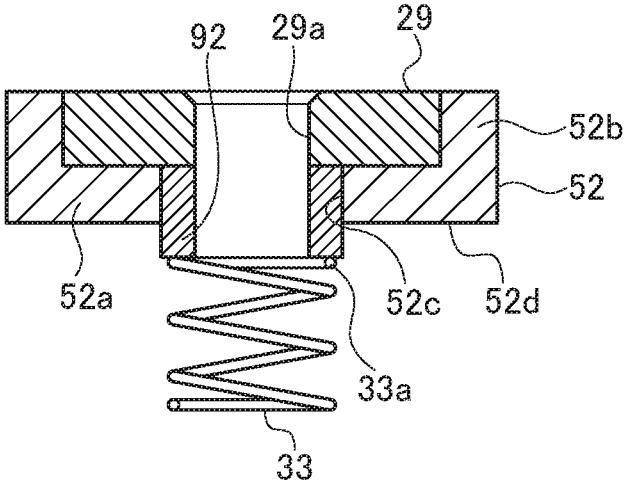
FIG. 34 is a cross-sectional view schematically showing a sixth modification of the condition in which the movable contactor is pressed by the contact pressure spring.

In FIG. 34, the spacer 92 formed from a member other than the yoke 50 and the movable contactor 29 is inserted in the insertion hole 52*c* of the lower yoke 52. The lower surface of the spacer 92 is formed to be located lower than the lower surface (the surface of the yoke 50 on the opposite side in the driving shaft direction) 52*d* of the lower yoke (first yoke) 52 (i.e., located on the opposite side in the driving shaft direction).

Furthermore, the contact pressure spring (biasing portion) 33 includes the upper end (biasing end) 33*a* configured to make the upward biasing force act on the movable contactor 29 by pressing the spacer 92 which is a member other than the movable contactor 29. The upper end (biasing end) 33*a* of the contact pressure spring (biasing portion) 33 is configured to press the lower surface of the projection 29*m*.

In other words, the upper end (biasing end) 33*a* of the contact pressure spring (biasing portion) 33 is located lower than the lower surface (the surface of the yoke 50 on the opposite side in the driving shaft direction) 52*d* of the lower yoke (first yoke) 52 (i.e., located on the opposite side in the driving shaft direction).

This configuration can also bring about the same operation/working effect as the foregoing embodiment.

It should be noted that apart of the spacer 92 which projects downward from the lower surface 52*d* of the lower yoke 52 may be provided with a flange portion or the like such that the flange portion or the like overlaps the lower surface 52*d* in the view in the driving shaft direction. In this case, the upper end (biasing end) 33*a* may be configured to indirectly press the yoke 50 upward by making the flange portion or the like press the lower surface 52*d*.

Furthermore, the material, shape, placement location or the like of the spacer may be designed depending on the necessity.

As described above, a member other than the yoke 50 and the movable contactor 29 may be interposed between the upper end (biasing end) 33*a* of the contact pressure spring (biasing portion) 33 and the movable contactor 29 such that the movable contactor 29 is biased upward with the member other than the yoke 50 and the movable contactor 29 in between.

It should be noted that in the configurations shown in FIGS. 29 to 34, the lower yoke (first yoke) 52 and the movable contactor 29 do not have to or may be fixed to each other. In the case where the lower yoke (first yoke) 52 and the movable contactor 29 are fixed to each other, the fixing may be performed using the above-described fixing means. Moreover, in the configurations shown in FIGS. 29 to 31, the lower yoke (first yoke) 52 and the movable contactor 29 may be fixed to each other by press-fitting the projection 29*m* to the insertion hole 52*c* of the lower yoke 52 instead of using the above-described fixing means. Otherwise, the projection 29*m* may be press-fitted in the insertion hole 52*c* of the lower yoke 52 in addition to using the above-described fixing means.

Figure 35:
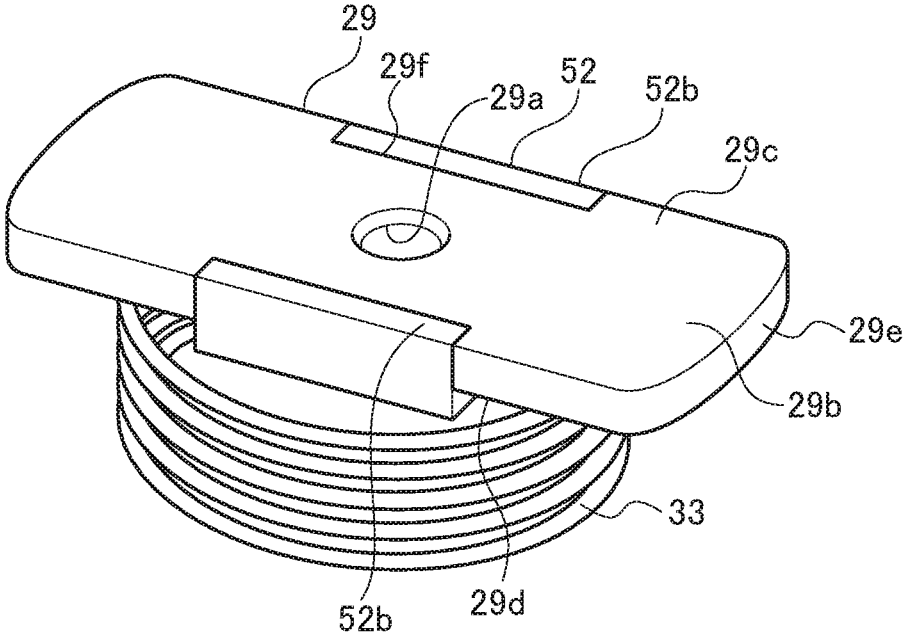
FIG. 35 is a cross-sectional view schematically showing a seventh modification of the condition in which the movable contactor is pressed by the contact pressure spring.

In FIG. 35, the upper end (biasing end) 33*a* of the contact pressure spring (biasing portion) 33 is in contact with the lower surface 29*d* which is exposed to the outside of the lower yoke 52.

To put it concretely, the diameter of the contact pressure spring 33 is enlarged such that in the view in the driving shaft direction, the lower yoke 52 is included in a circle drawn by the contact pressure spring 33.

This configuration can also bring about the same operation/working effect as the foregoing embodiment.

Figure 36:
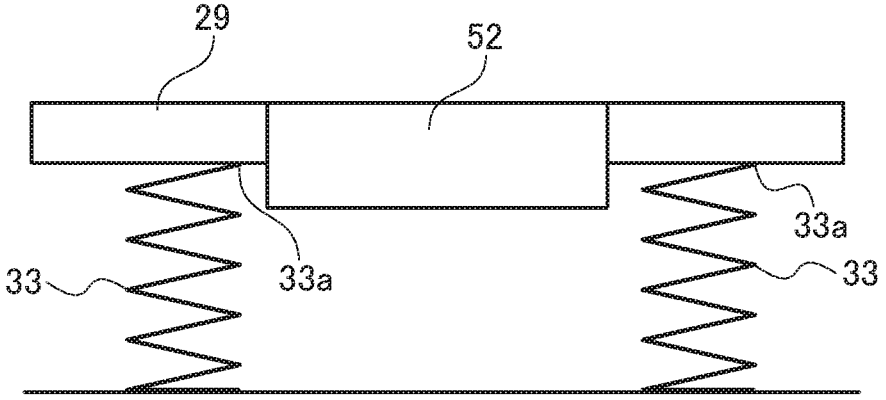
FIG. 36 is a cross-sectional view schematically showing an eighth modification of the condition in which the movable contactor is pressed by the contact pressure spring.

In FIG. 36, two (multiple) contact pressure springs 33 are used such that the upper ends (biasing ends) 33*a* of the contact pressure springs (biasing portions) 33 are in contact with parts of the lower surface 29*d* which are exposed to the outside of the lower yoke 52. In other words, the upper ends (biasing ends) 33*a* of the contact pressure springs 33 are configured to make the upward biasing force act on the movable contactor 29 by pressing a member (the movable contactor 29) which is other than the yoke 50, instead of by directly pressing the yoke 50.

This configuration can also bring about the same operation/working effect as the foregoing embodiment.

It should be noted that, in the case where multiple contact pressure springs 33 are used, it suffices that the contact pressure springs 33 include at least one biasing end located higher than the lower surface 52*d* of the lower yoke (first yoke) 52, and configured to make the upward biasing force act on the movable contactor 29 without being in contact with the lower yoke (first yoke) 52. For example, a pressing unit may be formed of a contact pressure spring (biasing portion) 33, and two auxiliary springs. Then, only the upper end (biasing end) 33*a* of the contact pressure spring (biasing portion) 33 is out of contact with the lower yoke 52 (the yoke 50); and the upper ends (biasing ends) of the other two auxiliary springs are in contact with the lower yoke 52 (the yoke 50). Otherwise, the upper ends (biasing ends) of the other two auxiliary springs are in contact with the lower yoke 52 (the yoke 50) with a member (the movable contactor 29, or another member) other than the yoke 50 interposed in between.

Figure 37:
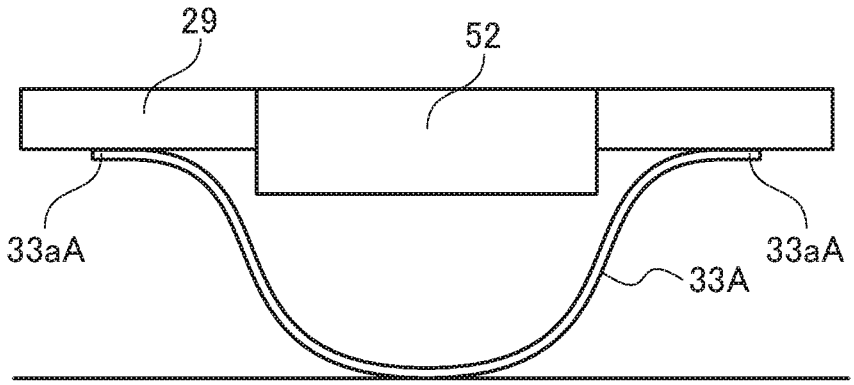
FIG. 37 is a cross-sectional view schematically showing a ninth modification of the condition in which the movable contactor is pressed by the contact pressure spring.

In FIG. 37, one plate spring 33A is used such that two ends (biasing ends, or two upper ends in FIG. 37) 33*a*A of the plate spring (biasing portion) 33A are in contact with parts of the lower surface 29*d* which are exposed to the outside of the lower yoke 52. Thereby, the two ends 33*a*A of the plate spring 33A serve as the biasing ends to make the upward biasing force act on the movable contactor 29 by directly pressing the movable contactor 29 which is a member other than the yoke 50.

This configuration can also bring about the same operation/working effect as the foregoing embodiment.

Figure 38:
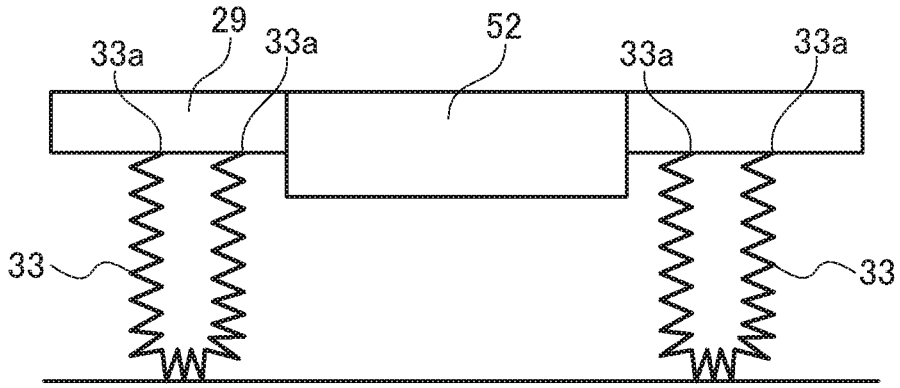
FIG. 38 is a cross-sectional view schematically showing a 10th modification of the condition in which the movable contactor is pressed by the contact pressure spring.

In FIG. 38, each contact pressure spring 33 is bent in the shape of the letter U such that the two ends 33*a* of the contact pressure spring 33 serve as biasing ends to make the upward biasing force act on the movable contactor 29 by directly pressing the movable contactor 29 which is a member other than the yoke 50. Although FIG. 38 shows an example of using two contact pressure springs 33 each bent in the shape of the letter U, the number of contact pressure springs to be used, and the number of contact pressure springs to be bent in the shape of the letter U may be set depending on the necessity.

This configuration can also bring about the same operation/working effect as the foregoing embodiment.

Although the preferable embodiment of the present invention has been described, the present invention is not limited to the embodiment, and various modifications may be made to the embodiment.

For examples, the embodiment and the modifications show the example where the movable contactor 29 is surrounded by the upper yoke 51 and the lower yoke 52. Instead, however, the movable contactor 29 may be provided with only the lower yoke 52. In addition, the shape of the lower yoke 52 is not limited to those shown above. As long as the lower yoke 52 is disposed at least on the lower side of the movable contactor 29 (on the opposite side in the driving shaft direction) (i.e., disposed in contact with the lower surface 29*d*) while the movable contacts 29*b* are in contact with the fixed contacts 35*a* (in the embodiment, while the power supply is on), various shapes may be used for the lower yoke 52.

In addition, the flange portion 25*a* of the shaft 25 may serve as the upper yoke.

Furthermore, the press-fitting projections and the swaging projections may be formed using methods which are other than the dowel formation processing.

Moreover, the configuration in which the coil 13 is wound around the multiple (two) coil bobbins 11 (the configuration shown in FIG. 39) is applicable to the contact device 1.

Besides, the structures shown in the embodiment and the modifications may be combined depending on the necessity. For example, the configurations shown in FIGS. 29 to 38 are applicable to the configuration shown in FIG. 26.

In addition, the detailed specifications (shapes, sizes, layouts and the like) of the movable contactor, the fixed terminals and the like may be changed depending on the necessity.

INDUSTRIAL APPLICABILITY

The present invention makes it possible to obtain a contact device and an electromagnetic relay mounting the contact device which both achieve an inhibition the positional displacement of the yoke relative to the movable contactor.

The invention claimed is:

1. A contact device comprising:

a contact block including:

a fixed contact, and a movable contactor including a movable contact formed to come into and out of contact with the fixed contact, the movable contact formed on a first side of the movable contactor;

a driving block including a driving shaft which moves the movable contactor, the driving block configured to drive the driving shaft so that the movable contact can come into and out of contact with the fixed contact along a driving direction along the driving shaft; and a yoke disposed on a second side of the movable contactor and fixed to the movable contactor, the second side of the movable contactor facing the first side of the movable contactor in the driving direction;

wherein one of the yoke and the movable contactor includes a projection projected along the driving direction, and the other of the yoke and the movable contactor includes an insertion hole in which to insert the projection.

2. The contact device according to claim 1, wherein the projection is fixed in the insertion hole.

3. The contact device according to claim 1, wherein the projection is press-fitted to the insertion hole.

4. The contact device according to claim 1, wherein the projection formed in the one is fixed to the other by swaging.

5. The contact device according to claim 1, wherein the insertion hole includes a step, and the projection is fixed to the step by swaging.

6. The contact device according to claim 1, wherein the projection is welded to the insertion hole.

7. The contact device according to claim 1, wherein the insertion hole includes a tapered portion with which the projection is brought into contact.

8. The contact device according to claim 1, wherein the projection is formed by dowel formation processing.

9. The contact device according to claim 1, wherein the one is the yoke and the other is the movable contactor, and the yoke includes the projection and a bottom wall portion provided with the projection, wherein the yoke is fixed to the movable contactor by interposing a part of the movable contactor between the projection and the bottom wall portion in the driving direction.

10. The contact device according to claim 1, wherein the one is the yoke and the other is the movable contactor, and the yoke includes a first member as the projection and a second member provided with the projection, wherein the yoke is fixed to the movable contactor by interposing a part of the movable contactor between the first member and the second member in the driving direction.

11. The contact device according to claim 1, wherein the projection is formed in a state where the one of the yoke and the movable contactor is bended such that the projection projects to the driving direction.

12. The contact device according to claim 1, wherein the yoke includes a bottom wall portion, and side wall portions formed to two ends of the bottom wall portion and projecting in the driving direction.

13. The contact device according to claim 1, further comprising a biasing portion configured to bias the movable contactor toward the other side in the driving direction.

14. An electromagnetic relay mounted the contact device according to claim 1 to open and close the fixed contact and the movable contact depending on whether or not a coil is electrified.

15. The contact device according to claim 1, wherein the yoke includes the projection projected along the driving direction and the movable contactor includes the insertion hole in which to insert the projection.

* * * * *